US007571685B2

(12) United States Patent
Hart et al.

(10) Patent No.: US 7,571,685 B2
(45) Date of Patent: Aug. 11, 2009

(54) FREIGHT RAILROAD CAR REFLECTOR

(75) Inventors: Daniel L. Hart, Antioch, IL (US); John D. Anderson, Aurora, IL (US); Walter J. Peach, South Elgin, IL (US)

(73) Assignee: ZefTek, Inc., Montgomery, IL (US)

( * ) Notice: Subject to any disclaimer, the term of this patent is extended or adjusted under 35 U.S.C. 154(b) by 478 days.

(21) Appl. No.: 11/277,216

(22) Filed: Mar. 22, 2006

(65) Prior Publication Data

US 2006/0214503 A1 Sep. 28, 2006

Related U.S. Application Data

(60) Provisional application No. 60/664,303, filed on Mar. 22, 2005.

(51) Int. Cl.
*G02B 5/00* (2006.01)

(52) U.S. Cl. ..... 105/355; 105/463.1; 359/549; D10/111

(58) Field of Classification Search ..... D10/111, D10/113, 114, 17; 359/515, 516, 520, 521, 359/522, 523, 524, 533, 549, 550, 551, 552, 359/553; 411/376, 372, 372.6, 176, 190; 439/67

See application file for complete search history.

(56) References Cited

U.S. PATENT DOCUMENTS

| | | | | |
|---|---|---|---|---|
| 2,551,193 | A | 5/1951 | Williams | |
| D223,521 | S * | 4/1972 | Sheward | D10/111 |
| 4,201,448 | A | 5/1980 | Kagayama | |
| 4,784,068 | A | 11/1988 | Burke | |
| 4,913,062 | A | 4/1990 | Burke | |
| D337,131 | S | 7/1993 | Wilson | |
| 5,239,933 | A | 8/1993 | Murphy et al. | |
| 5,415,108 | A | 5/1995 | Murphy et al. | |
| D369,568 | S | 5/1996 | Sloot | |
| 5,579,697 | A | 12/1996 | Burke | |
| 5,687,650 | A | 11/1997 | Murphy et al. | |
| 5,694,859 | A | 12/1997 | Burke et al. | |
| 5,701,825 | A | 12/1997 | Peach, Jr. | |
| D412,131 | S | 7/1999 | Bent | |
| 6,095,350 | A | 8/2000 | Sauer | |
| D440,513 | S | 4/2001 | Smith | |
| D442,062 | S | 5/2001 | Kelly et al. | |
| 6,305,312 | B1 | 10/2001 | Bent et al. | |
| 6,553,917 | B1 | 4/2003 | Burke et al. | |
| 6,561,740 | B1 | 5/2003 | Burke et al. | |
| 6,926,537 | B1 * | 8/2005 | Auchincloss et al. | 439/67 |
| 7,048,391 | B2 | 5/2006 | Greeves | |
| 2003/0107810 | A1 * | 6/2003 | Greves | 359/516 |

OTHER PUBLICATIONS

Description of Known Raiload Car Kick Plates.

(Continued)

*Primary Examiner*—Mark T Le
(74) *Attorney, Agent, or Firm*—K&L Gates LLP

(57) ABSTRACT

A freight railroad car equipped with a plurality of spaced apart reflector apparatus which can be easily and readily installed on the freight railroad car in shorter time periods than the previously known adhesive backed reflective tape. One embodiment of the freight railroad car reflector apparatus includes a mounting member, a reflector material attached to the mounting member and a plurality of fasteners or attachment mechanisms used to attach the mounting member to the freight railroad car.

14 Claims, 32 Drawing Sheets

OTHER PUBLICATIONS

ZefTek Product Guide, published Jan. 2003.
ZefTek Car Parts Brochure, published Aug. 1998.
ZefTek Cost Cutting Car Components Brochure.
Holland Transportation Technology Rail Car Components Brochure.
The Holland Company Freight Car Components Brochure.
Federal Register, Department of Transportation, vol. 70, No. 1 dated Jan. 3, 2005.
Salco Products, Inc. Brochure.
Association of American Railroads Circular Letter dated Mar. 1, 2005.
ZefTek Vented and Non-Vented 20" Hatch Covers Pamphlet.

* cited by examiner

FREIGHT RAILROAD CAR REFLECTOR

PRIORITY CLAIM

This application is a non-provisional application of, claims the benefit of and priority to U.S. Provisional Application Ser. No. 60/664,303, filed Mar. 22, 2005, the entire contents of which are incorporated herein.

CROSS-REFERENCE TO RELATED APPLICATIONS

This application relates to the following commonly owned patent applications: "FREIGHT RAILROAD CAR REFLECTOR," Ser. No. 29/246,213, now Pat. No. Des. 541,700; and "FREIGHT RAILROAD CAR REFLECTOR," Ser. No. 29/246,211, now Pat. No. Des. 541,193.

BACKGROUND

Thousands of people are hurt or killed at railroad crossings each year. Railroad crossings in urban and suburban areas usually have conventional warning systems such as lighting systems and/or gates which block entry to the railroad tracks when trains approach and pass through the crossings. However, many railroad crossings in rural areas do not have any warning systems. These crossings usually have signs to alert drivers of vehicles that they are about to cross over railroad tracks. During daylight hours, these signs and the tracks are usually readily visible. During night time hours, these signs and the tracks are much less visible, and sometimes based on conditions hardly visible at all.

Conventional freight railroad cars are not illuminated and are not equipped or constructed with reflective materials. During night time hours, many accidents occur simply because the drivers of vehicles cannot see the dark freight railroad cars and do not know that freight railroad cars are running through the crossing. These vehicles simply run into the moving railroad cars. This problem for vehicles (as well as for snowmobiles and ATV's) is so common that on Jan. 3, 2005, the United Sates Federal Railroad Administration issued final regulations mandating that reflective material be placed on all freight railroad cars within ten years or by 2015 at least according to a minimum schedule set forth in the regulations. The regulations are 49 CFR Part 224 entitled "Reflectorization of Rail Freight Rolling Stock; Final Rule." These regulations further describe the extent of the existing problems. These regulations require railroads to place reflective material of minimum designated sizes on the freight railroad cars at minimum spaced apart designated positions.

This is an extraordinarily large and expensive undertaking for the railroads because there are over 1.6 million freight railroad cars and locomotives in North America. For purposes of this application, the term freight railroad cars includes locomotives. Each railroad car will have approximately 14 to 22 pieces of reflective material mounted on that railroad car. Thus, between 22 million and 35 million pieces of reflective material will need to be mounted on the freight railroad cars. Equipping the large number of freight railroad cars in accordance with these regulations has been and continues to be an extremely slow process, in part because the railroads are equipping their freight cars by directly placing adhesive backed reflective tape on portions of the freight railroad cars such as the frames and side walls of the freight railroad cars. There are several problems with attaching such reflective tape directly to the freight railroad cars. One problem is that the freight railroad cars must be taken out of service for a relatively significant amount of time during the attachment process. Another problem is that the freight railroad cars are usually extremely dirty and must be cleaned before the adhesive backed reflective tape is directly placed on the freight railroad cars for proper adherence. Another problem is the freight railroad cars tend to be rusty and the adhesive backed tape does not adhere to rust very well. This cleaning may include washing, sanding, blasting, grinding, painting and drying processes. The cleaning can take several hours for each freight railroad car. This cleaning is thus extremely time consuming, inefficient and expensive. This overall process of directly attaching adhesive backed reflective tape to each freight railroad car can take between 2 to 5 hours. This is a substantial man-hour cost. These problems dramatically slow the entire process of equipping the 1.6 million freight railroad cars according to the regulations.

To avoid these problems and significant costs, some railroads may be directly applying reflective tape to the dirty freight railroad cars to save time and cost. The problem with this is that the adhesive backed reflective tape is much more likely to not stick to, peel off or otherwise come off such dirty or rusty surfaces, and thus result in a freight railroad car without the necessary reflective material according to the regulations. After the reflective material comes off, it is less likely to be put back on in a short time period.

A further problem is that the adhesive backed reflective tape is preferably applied when the temperature is above 50 degrees Fahrenheit. If the temperature is significantly below 40 degrees Fahrenheit, and particularly if the surface of the freight railroad car is below 40 degrees Fahrenheit, then the adhesive backed reflective tape may not readily stick to the surface of the freight railroad car. Similarly, a further problem is that it is difficult to apply the reflective tape in bad weather such as rain or snow. This also dramatically increases the time and cost of equipping freight railroad cars according to the regulations.

Another problem with directly applying reflective tape to the freight railroad cars is that many surfaces of the freight railroad cars are not flat because they have been dented or otherwise damaged. This can further slow down the installation process and can cause the reflective tape to peel or otherwise come off more readily. A further problem is that the adhesive backed reflective tape directly applied to the railroad is not protected and is subject to external forces which can cause damage to the reflective tape.

Accordingly, there is a need for a much easier, much faster and less expensive method and apparatus for equipping freight railroad cars with reflective material according to the regulations.

Additionally, there is a need for a method and apparatus that will encourage railroads to equip their freight railroad cars ahead of the schedule required by the regulations.

SUMMARY OF THE INVENTION

The present invention provides a much faster, much more cost efficient and much easier apparatus and method for equipping freight railroad cars in accordance with the regulations set forth in 49 CFR Part 224. In one embodiment, the present invention provides a plurality of freight railroad car reflectors or reflector apparatus which are each attached to a freight railroad car at spaced apart locations along the exterior side walls of the freight railroad car. The freight railroad car reflectors are each suitably sized and can each be attached horizontally, vertically or otherwise in accordance with the regulations. Each freight railroad car reflector or reflector apparatus can be easily and quickly attached to the freight railroad car without the need to clean the freight railroad car and without the need for the temperature being at minimum levels or the weather being otherwise good. Moreover, the freight railroad cars may not need to be taken out of service or only taken out of service for a relatively short period of time.

One embodiment of the railroad car reflector apparatus of the present invention includes a mounting member, a reflector or reflector material attached to the mounting member and one or more fasteners or attachment mechanisms used to easily and quickly attach the railroad car reflectors to the freight railroad car. In one embodiment, the fasteners or attachment mechanisms are inserted though mounting apertures in the mounting member of the railroad car reflector and into existing holes in the freight railroad cars such as in the side wall screens of autorack railroad cars. In other embodiments, the fastener or attachment mechanism is maintained by the mounting member. In one such embodiment, the fasteners or attachment mechanisms include weld washers integrally formed with the mounting members of the railroad car reflector to facilitate quick welding of the railroad car reflector to the freight railroad car. In further embodiments, the fasteners or attachment mechanisms such as weld washers are configured to be easily attached to and removably held by the mounting members to facilitate quick welding of the railroad car reflector to the freight railroad car. These embodiments provide apparatus and methods for easy assembly of the attachment mechanisms and the mounting members and thus simplify the manufacturing process and installation procedures of the railroad car reflector. Other suitable attachment mechanisms can be employed in accordance with the present invention. The present invention thus contemplates a method of attaching reflective material to freight railroad cars in an easy, cost efficient, and effective manner.

The present invention thus contemplates a freight railroad car and particularly an improved freight railroad car equipped with a plurality of spaced apart reflector apparatus. The present invention further contemplates that because the reflector apparatus of the present invention can be easily and readily installed in shorter time periods than the previous direct attachment of the adhesive backed reflective tape, that more railroad cars can be more quickly installed with these reflector apparatus and that less accidents can occur and that less people will be hurt or killed.

Additional features and advantages of the present invention are described in, and will be apparent from, the following Detailed Description of the Invention and the figures.

DETAILED DESCRIPTION OF THE INVENTION

Figure 1:
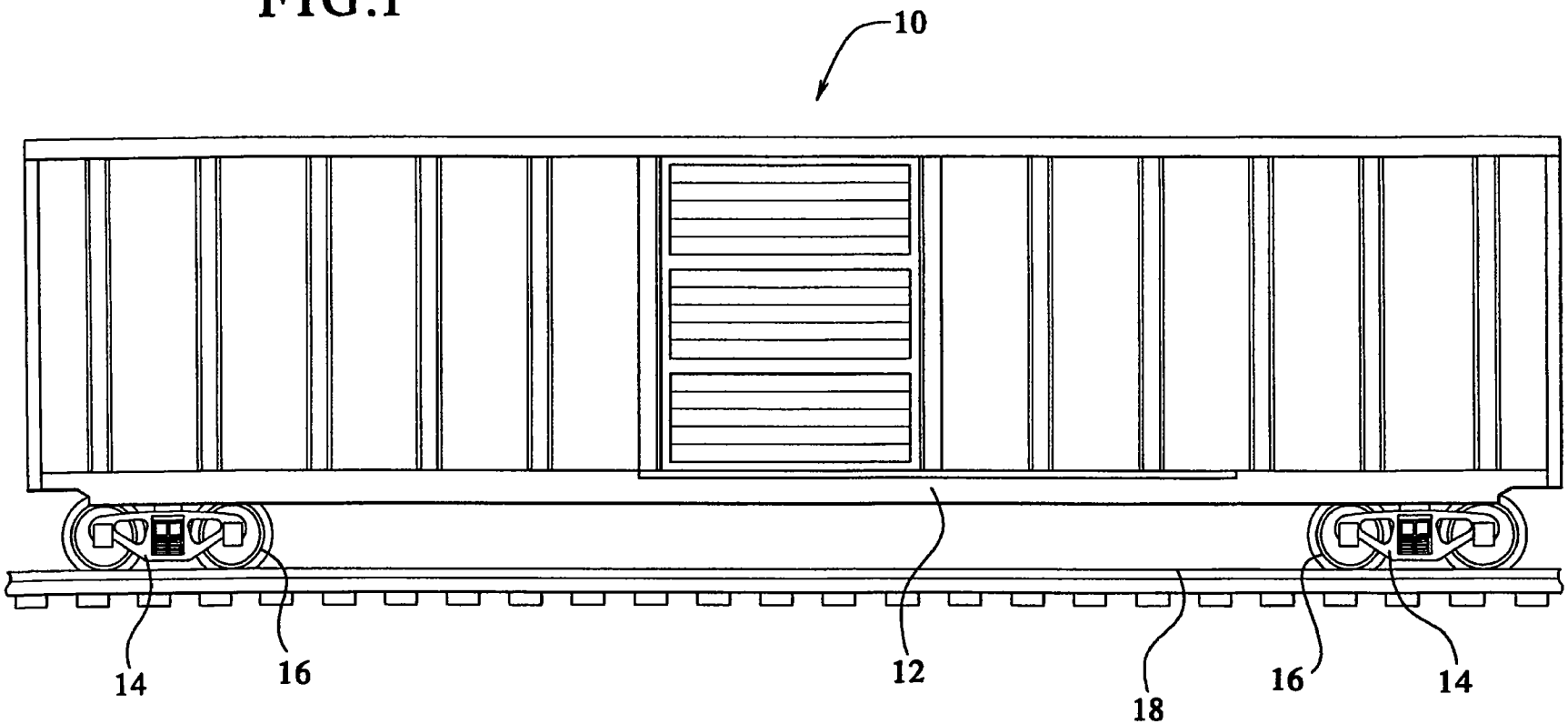
FIG. 1 is a side view of a conventional freight railroad car.

Referring now to the figures, FIG. 1 illustrates one type of freight railroad car 10. There are numerous different types of freight railroad cars. The present invention can be employed on any freight railroad car. The freight railroad car 10 includes a frame 12 supported by trucks 14, each of which have several wheels 16 which roll along railroad tracks 18. The frame 12 supports the load transported by the freight railroad car. Freight railroad cars vary in the frame and the structure above the frame depending upon the transported products. For instance, box cars usually have four walls including spaced-apart opposing side walls, spaced-apart opposing end walls, a roof attached to the walls and at least one door. The door provides access to the interior storage compartment defined by the walls and roof.

Figure 2:
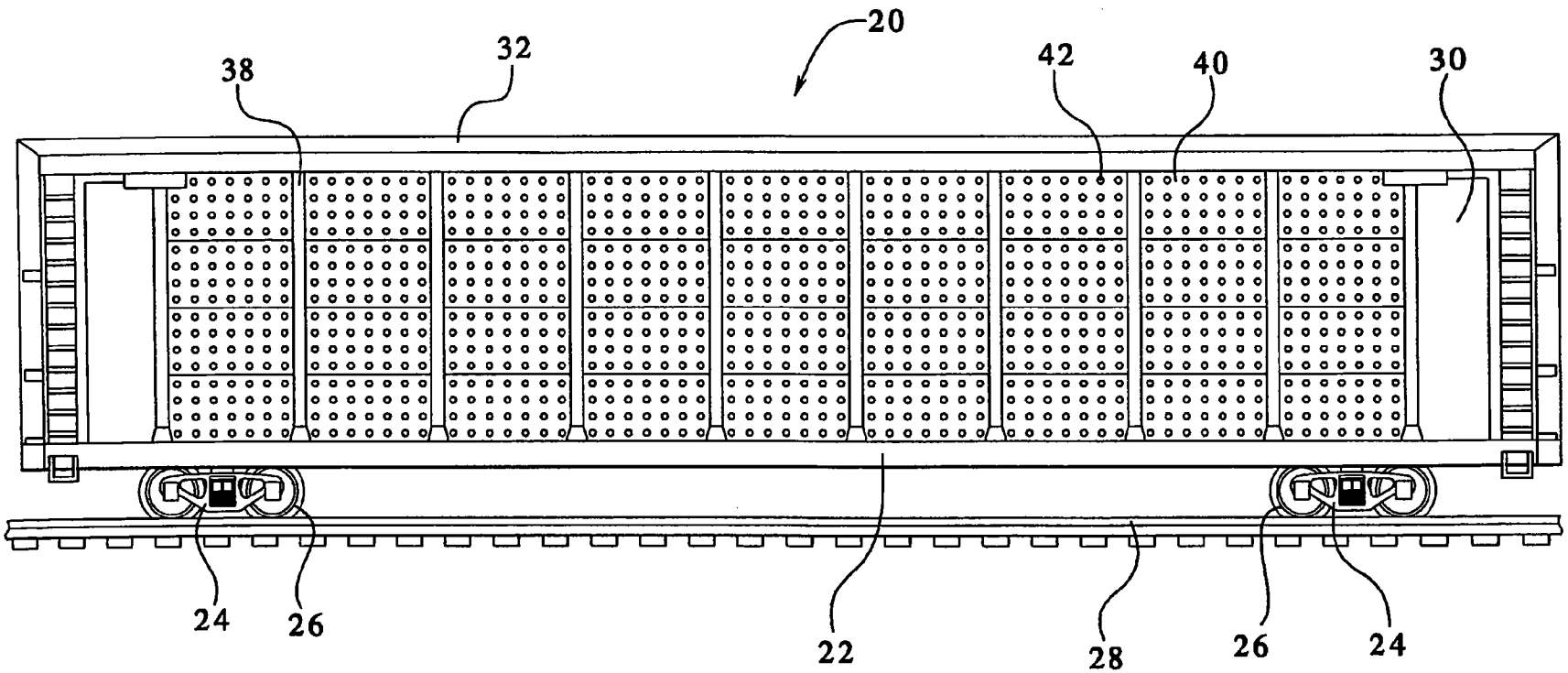
FIG. 2 is a side view of a conventional autorack railroad car.

Another known type of freight railroad car is an autorack railroad car 20 generally illustrated in FIG. 2. The autorack railroad car 20 includes a frame 22 supported by trucks 24, each of which have several wheels 26 which roll along railroad tracks 28. The frame 22 supports two sidewalls 30 and a roof 32. The autorack car includes a pair of co-acting clamshell doors mounted on each end of the autorack car. The doors are opened to facilitate the loading and unloading of vehicles into and out of the autorack car and are closed during transport or storage of the vehicles.

The sidewalls of an autorack railroad car includes a series of steel vertical posts 38 which are mounted on and extend upwardly from the frame 22. The roof 32 is mounted on and supported by these vertical posts. The vertical posts are spaced along the entire length of both sidewalls of the autorack car. A plurality of rectangular galvanized steel sidewall panels 40 which extend horizontally and are vertically spaced apart are mounted between each pair of vertical posts 38. These sidewall panels are supported at their corners by brackets (not shown) that are suitably secured to the vertical posts. The average sidewall panel has a multiplicity of round sidewall panel holes 42. These sidewall panel holes 42 provide the autorack car with natural light as well as proper ventilation. Proper ventilation prevents harm from the toxic vehicle fumes to the person or persons loading or unloading the vehicles into or out of the autorack car.

The autorack car may be a tri-level car having first, second and third levels. Normally, eighteen passenger vehicles can be transported in a tri-level autorack car, six on each level. The autorack car can also have two levels for vehicles instead of three. The bi-level autorack car has a lower level and an upper level. The bi-level autorack car is generally used to transport larger vehicles, such as vans, mini-vans, pickup trucks, four-by-four and cross-over vehicles. The bi-level autorack car can usually transport twelve of these vehicles, six on each level. The autorack car may also be a single-level car.

Figure 3:
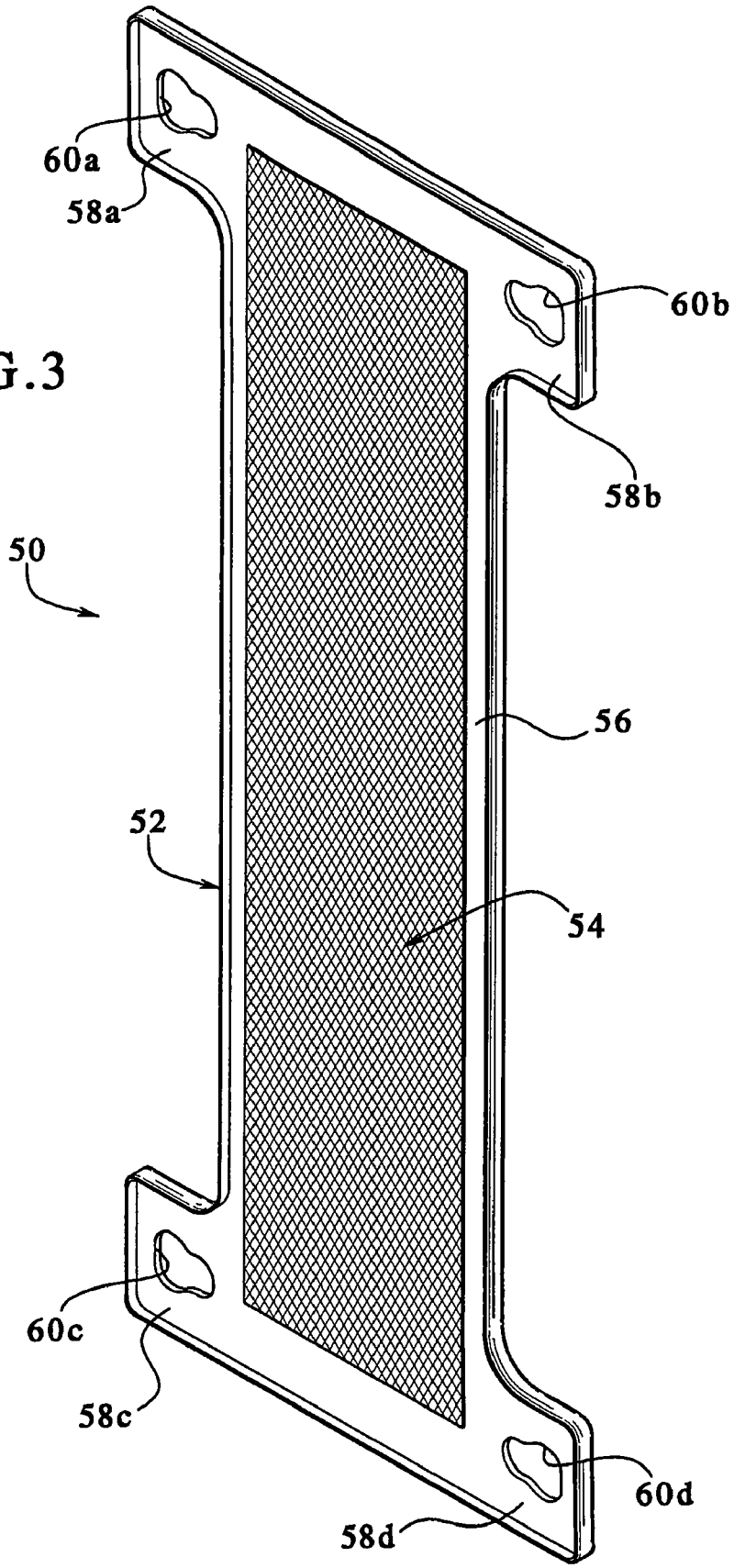
FIG. 3 is a front perspective view of a railroad car reflector apparatus of one embodiment of the present invention.
Figure 4:
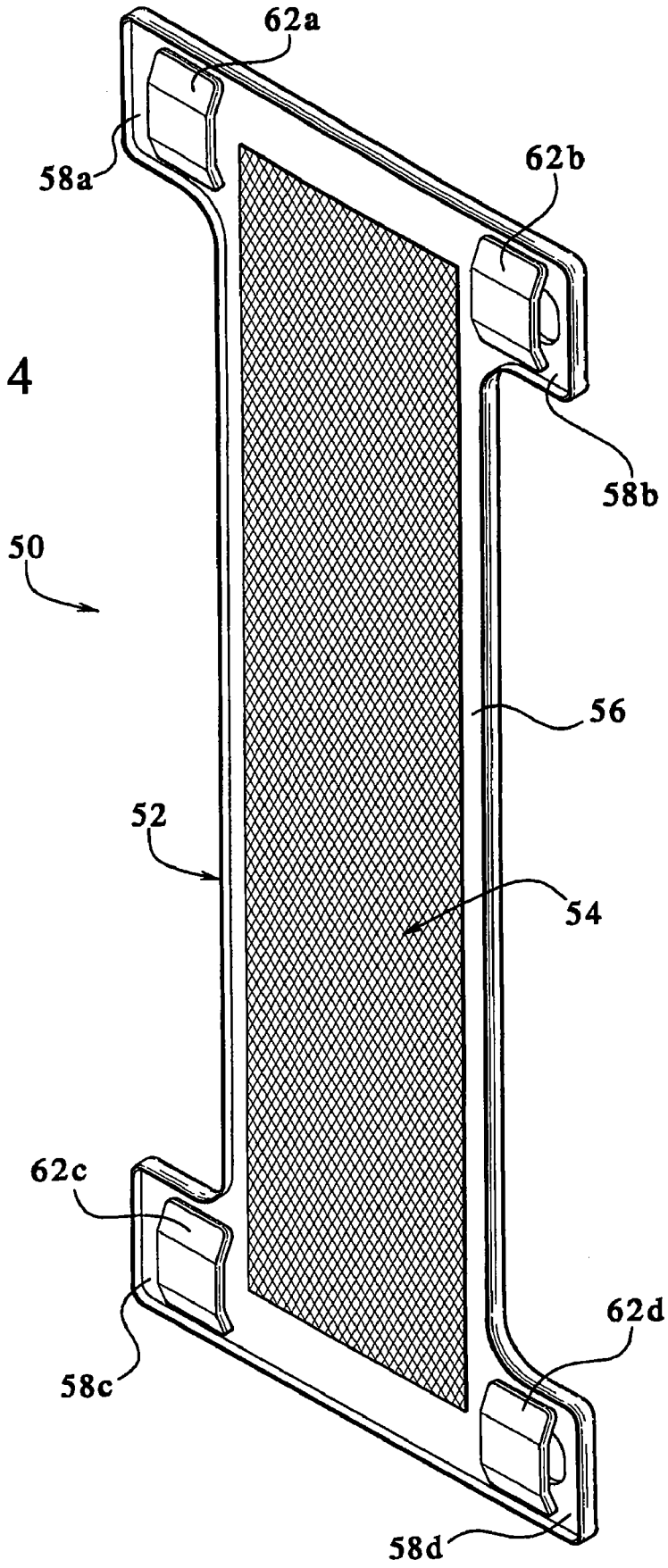
FIG. 4 is a front perspective view of the railroad car reflector apparatus of FIG. 3 showing the fasteners mounted in the mounting apertures.
Figure 5:
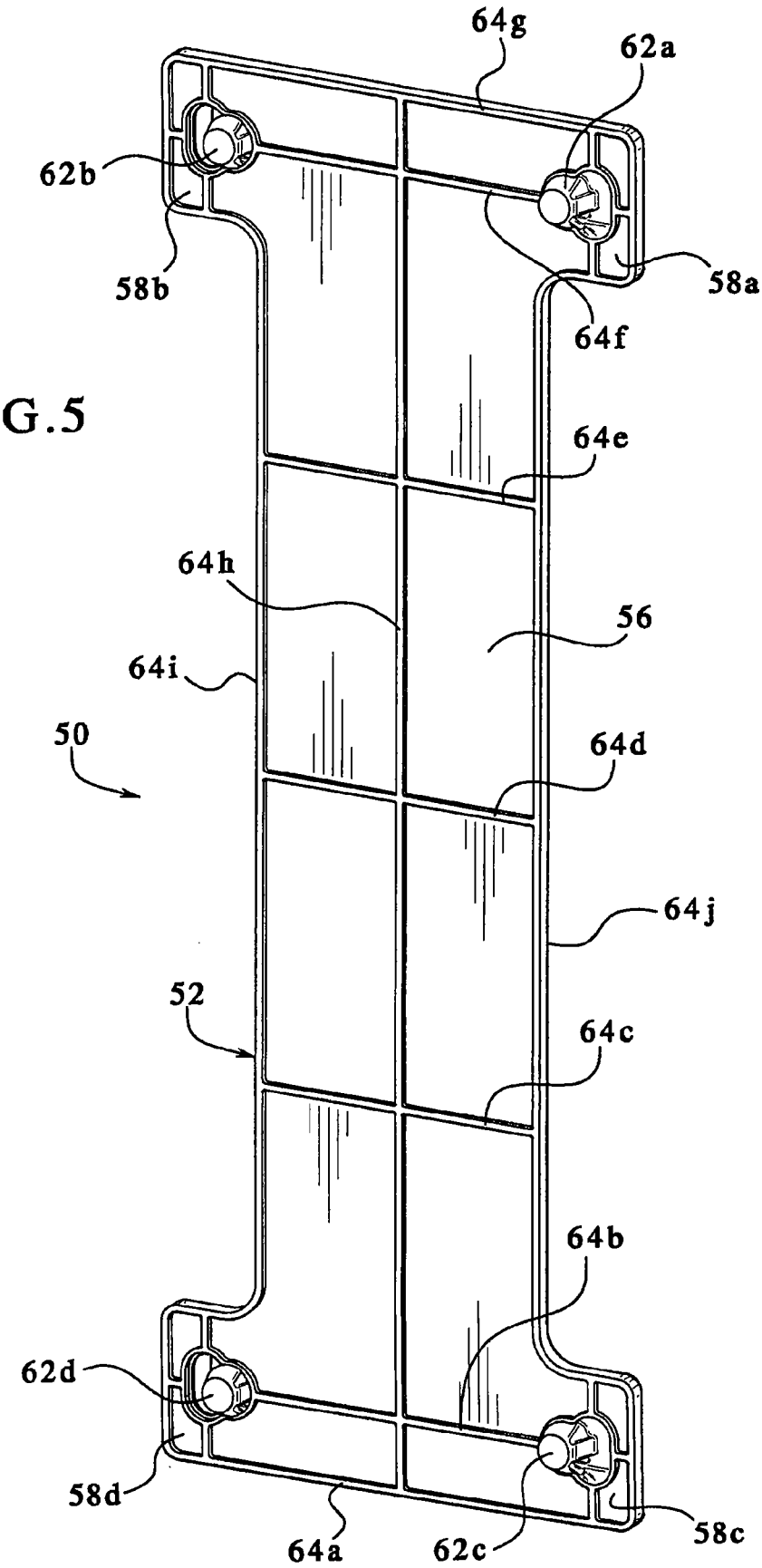
FIG. 5 is a rear perspective view of the railroad car reflector apparatus of FIG. 3 showing the fasteners mounted in the mounting apertures.
Figure 6:
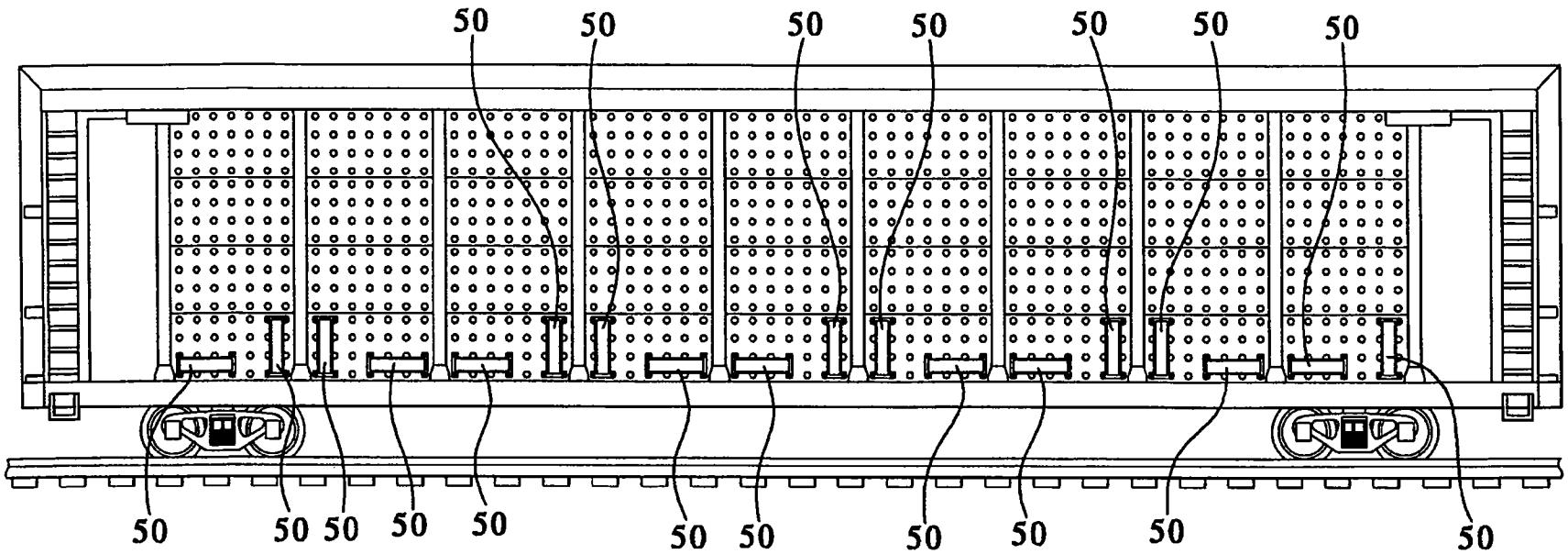
FIG. 6 is a side view of a conventional autorack railroad car with a plurality of railroad car reflector apparatus of FIG. 3 mounted along one of the side walls in vertical and horizontal positions.

FIGS. 3, 4, and 5 illustrate one embodiment of a freight railroad car reflector or reflector apparatus of the present invention which is generally indicated by numeral 50. The freight railroad car reflector apparatus 50 includes a mounting member or base 52 and a reflector 54 suitably attached to the mounting member or base 52. The mounting member or base 52 includes a reflector supporter 56 and a plurality of mounting sections such as mounting sections 58*a*, 58*b*, 58*c* and 58*d* connected to the reflector supporter 56. The mounting sections 58*a*, 58*b*, 58*c* and 58*d* extend transversely from opposing ends of the reflector supporter 56 and transversely from opposing sides of the reflector supporter 56 in this embodiment. The mounting sections 58*a*, 58*b*, 58*c* and 58*d* respectively define mounting apertures 60*a*, 60*b*, 60*c* and 60*d* configured to and for facilitating attachment of the reflector apparatus 50 to the freight railroad car, and more particularly in this illustrated embodiment to an autorack railroad car as generally illustrated in FIG. 6 and as further discussed below. It should be appreciated that in this embodiment and the other embodiments disclosed herein, one or more additional mounting members (such as centrally positioned mounting members extending transversely from the reflector support) may be employed to further secure the freight railroad car reflector apparatus to the freight railroad car.

In one embodiment, the reflector apparatus 50 also includes suitable fasteners or attachment mechanisms for attaching the mounting member or base 52 to the freight railroad car such as the fasteners or attachment mechanisms 62*a*, 62*b*, 62*c* and 62*d* as generally illustrated in FIGS. 4 and 5. The fasteners may be any suitable type of fastener which can or can be used to attach the mounting sections to the autorack railroad car sidewall panel screens. One such type of fastener is described in U.S. Pat. No. 5,239,933. Other suitable types of commercially available fasteners may be employed in accordance with the present invention.

As best illustrated in FIG. 3, each mounting section defines a mounting aperture which is shaped and sized to receive the fastener in at least one position and alternatively in two different positions. In the illustrated embodiment of FIGS. 3, 4, and 5, the mounting apertures 60*a*, 60*b*, 60*c* and 60*d* are shaped to facilitate attachment of the reflector apparatus in a vertical or substantially vertical position relative to the autorack railroad car or in a horizontal or substantially horizontal position relative to the autorack railroad car. These alternative mounting positions are generally illustrated in FIG. 6. More specifically, each mounting aperture has a first or horizontal diameter sized and shaped to allow for expansion and contraction of the mounting member 52 when the reflector apparatus is vertically mounted, and a second vertical diameter to allow for expansion and contraction of the mounting member 52 when the reflector apparatus is horizontally mounted. The first and second diameters are substantially transverse to each other in the illustrated embodiment.

The reflector apparatus 50 may be made from any suitable material(s). The mounting member or base 52 may be any suitable type of material such as a molded plastic or a stamped metal. The reflector 54 of the reflector apparatus 50 is in one embodiment a suitable adhesive backed reflective tape such as a reflective tape commercially available from 3M, Avery Dennison and Reflexite. These entities sell reflective tape approved by the Federal Railroad Association and labeled FRA-224. Certain requirements for such reflective tape are set forth in the above mentioned regulations. The present invention contemplates that the adhesive backed reflective tape can be placed on the reflector supporter in a controlled environment (such as in a factory or inside a suitable room where the temperature and other conditions are controlled and the reflector support is clean and flat) such that maximum adhesive properties are achieved. This provides a great advantage over directly placing the reflective tape on the freight railroad car in the field or in railroad car repair areas where suitable temperature, climate and conditions are not always possible to achieve the best adhesion and where the freight railroad cars must be cleaned or painted (as described above) prior to such placement. It should also be appreciated that other suitable types of reflective material may be employed in the freight railroad car reflector apparatus of the present invention.

To install the reflector apparatus 50 on an autorack railroad car in accordance with the method of the present invention, the installer simply takes the reflector apparatus and holds it adjacent to the exterior autorack railroad car side wall panel screen in the appropriate position and inserts the fasteners in each of the mounting apertures and through the holes in the side wall panel screen. The autorack railroad car does not have to be cleaned and does not have to be at a certain temperature (such as fifty degrees or above) or in other suitable conditions. This takes a couple of minutes for each side of the autorack railroad car. It should thus be appreciated that each autorack railroad car can be equipped with reflector apparatus (such as in FIG. 6) easily and quickly. The installation can be performed while an autorack railroad car is being loaded or unloaded.

It should also be appreciated that FIGS. 3, 4 and 5 illustrate that the mounting member or base 52 in one embodiment has structural supports such as supports or ribs 64*a*, 64*b*, 64*c*, 64*d*, 64*e*, 64*f*, 64*g*, 64*h*, 64*i* and 64*j* to provide substantial rigidity to the mounting member or base 52 and the entire reflector apparatus 50. Any suitable structural supports may be employed in the reflector apparatus to provide such rigidity. Additionally, the mounting apertures may have or be defined in part by structural supports. The supports of the reflector apparatus 50 also define an outer raised border, air deflector or air foil around the entire outer edge mounting member 52. This border, air deflector or air foil functions to deflect or redirect wind from engaging the leading edge of the reflector 54. This prevents peeling of the reflector material 54 from the mounting member 52. Because the air deflector or air foil is along all of the edges, the air deflector works to protect the leading edge whether the reflector apparatus 50 is placed in a vertical or horizontal position. This configuration also protects the reflector material regardless of the direction of movement of the freight railroad car. Alternatively, the air deflector can be along less than all of the edges such as along at least one edge, or along opposing edges in this embodiment and the other embodiments disclosed herein.

It should also be appreciated that the reflector supporter of the present invention can be recessed relative to the rest of the mounting member or have a recessed reflector receiving area to protect the edges of the reflector.

In alternative embodiments, the mounting member is substantially flat without the structural supports. This embodiment can be extruded from a suitable plastic and cut in a conventional manner. In certain such embodiments, the mounting apertures can be stamped out of the mounting sections in a conventional manner. It should thus be appreciated that the reflector apparatus of the embodiment of FIGS. 3 to 5 and the other embodiments described below can be alternatively formed or manufactured. Specifically, it should be appreciated that the embodiments disclosed herein may be somewhat altered to be alternatively manufactured such as by an extrusion process. It should also be appreciated that the mounting members can be connected to and extend along the opposing sides of the reflector supporter (and in such case the sides can be considered ends of the reflector supporter as defined herein).

Figure 6A:
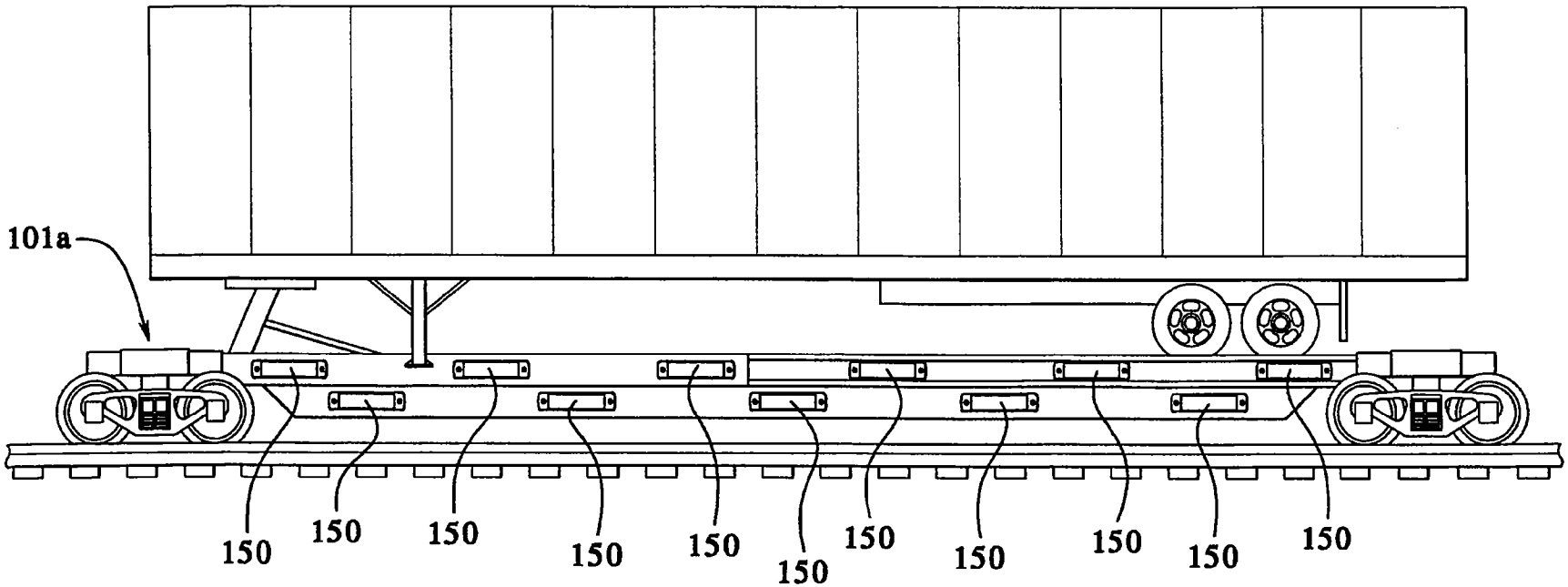
FIGS. 6A and 6B are side views of alternative freight railroad cars each with a plurality of railroad car reflector apparatus of one embodiment of the present invention mounted along one of the side walls.
Figure 6B:
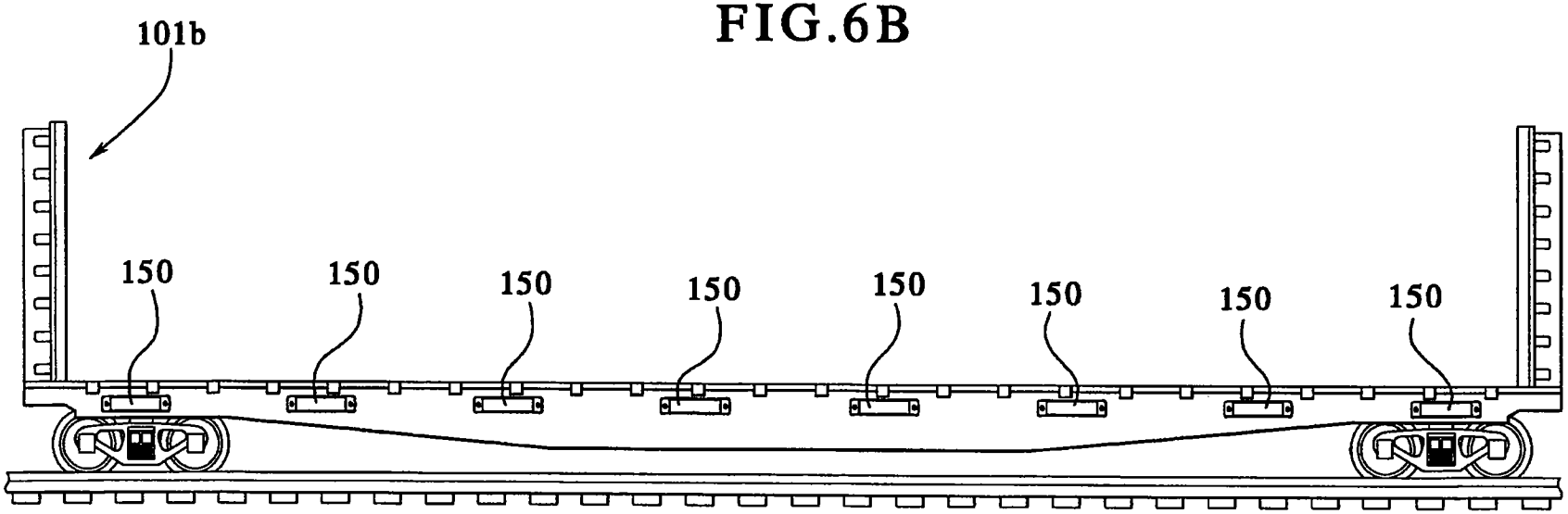

It should further be appreciated that there are many different freight cars and the present invention is configured to be employed for each different type. FIGS. 6A and 6B illustrate two example alternative freight railroad cars 101*a* and 101*b* having the railroad car reflectors 150 of one embodiment of the present invention discussed below.

Figure 7:
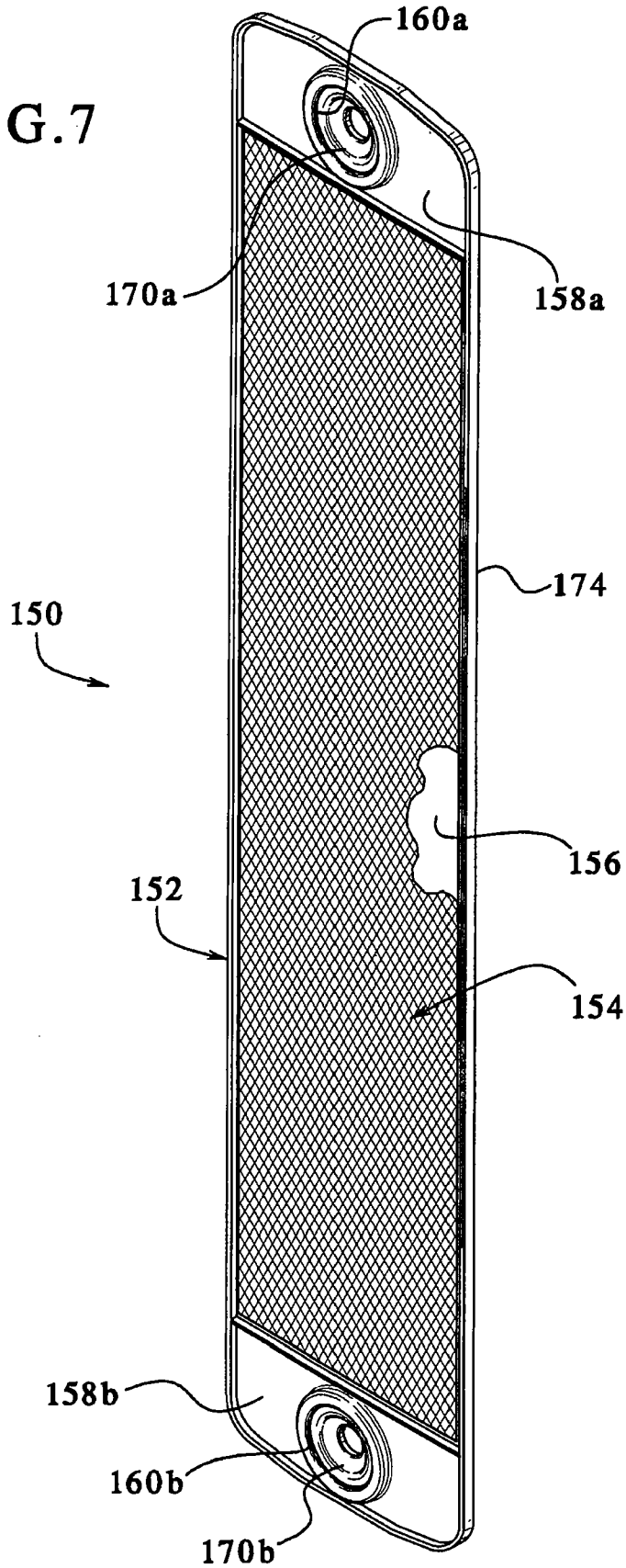
FIG. 7 is a front perspective view of the railroad car reflector apparatus of another embodiment of the present invention with a portion of the reflective material broken away to show the reflector supporter.
Figure 8:
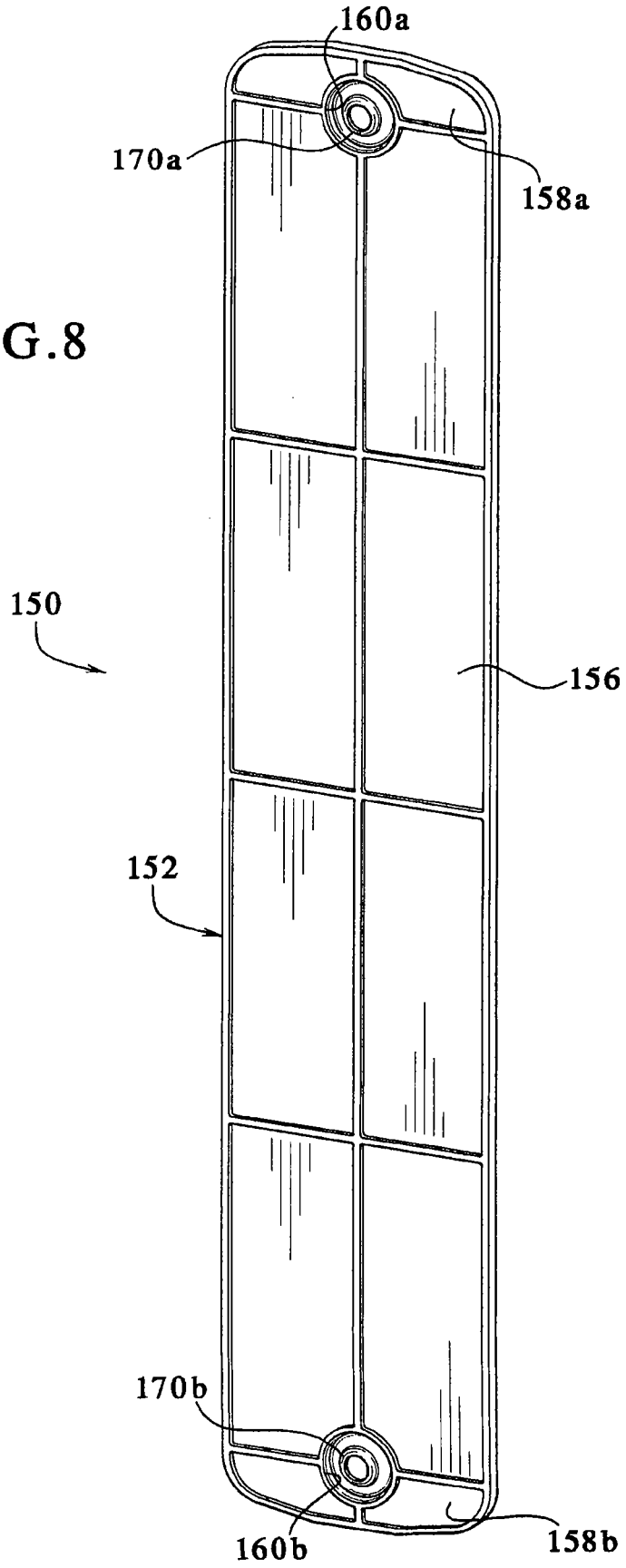
FIG. 8 is a rear perspective view of the railroad car reflector apparatus of FIG. 7.

FIGS. 7 and 8 illustrate another embodiment of the reflector apparatus of the present invention which is generally indicated by numeral 150. The freight railroad car reflector apparatus 150 includes a mounting member or base 152 and a reflector 154 suitably attached to the mounting member or base 152. The mounting member or base 152 includes a reflector supporter 156 and mounting sections 158*a* and 158*b* connected to the reflector supporter 156. The mounting sections 158*a* and 158*b* extend from opposing ends of the reflector supporter 156 in this embodiment. The mounting sections 158*a* and 158*b* respectively define mounting apertures 160*a* and 160*b* for facilitating attachment of the reflector apparatus 150 to the freight railroad car as generally illustrated in FIG. 9 and as further discussed below.

This embodiment includes attachment mechanisms in the form of circular weld washers 170*a* and 170*b* mounted in the mounting apertures 160*a* and 160*b*, respectively. The weld washers may be any suitable shape and any suitable material such as steel, aluminum or another metal. The weld washers 170*a* and 170*b* are molded into and thus integrally formed with the mounting sections 158*a* and 158*b* respectively during the molding process. Each weld washer illustrated has a centrally located aperture for facilitating the welding process. It should be appreciated that the weld washers may be otherwise suitably formed and shaped to facilitate the welding process. This facilitates easy and quick attachment of the reflector apparatus 150 to the freight railroad car in accordance with the method of the present invention. It should also be appreciated that to account for expansion and contraction of the plastic mounting member, the mounting aperture for the in-molded weld washer or other attachment mechanism may be oval or otherwise suitably shaped. In one such embodiment, the weld washer is maintained in the mounting aperture by the configuration of the mounting section in a movable or free floating manner to account for expansion and contraction.

More specifically, to install the reflector apparatus 150 on freight railroad car, the installer simply takes the reflector apparatus 150 and holds it adjacent to the freight railroad car exterior side wall in the appropriate position and welds each weld washer to the side wall. Because the weld washers 170*a* and 170*b* are integrally formed or molded in the mounting sections 158*a* and 158*b* respectively, the installer does not need to separately hold the reflector apparatus and weld washers. This facilitates easy and quick attachment of the reflective material to the freight railroad car in accordance with the method of the present invention. Additionally, the freight railroad car does not have to be cleaned and does not have to be at a certain temperature. While the welding process may take a couple of minutes for each reflector apparatus, this process is significantly shorter than the current cleaning processes mentioned above. It should thus be appreciated that each freight railroad car can be equipped with the reflector apparatus much easier and quicker than directly applying reflective tape to the freight railroad car. The welding also prevents the freight railroad car reflector from being easily removed from the freight railroad car (i.e., the welding forms a bond between the railroad car reflector and the freight car.)

Figure 9:
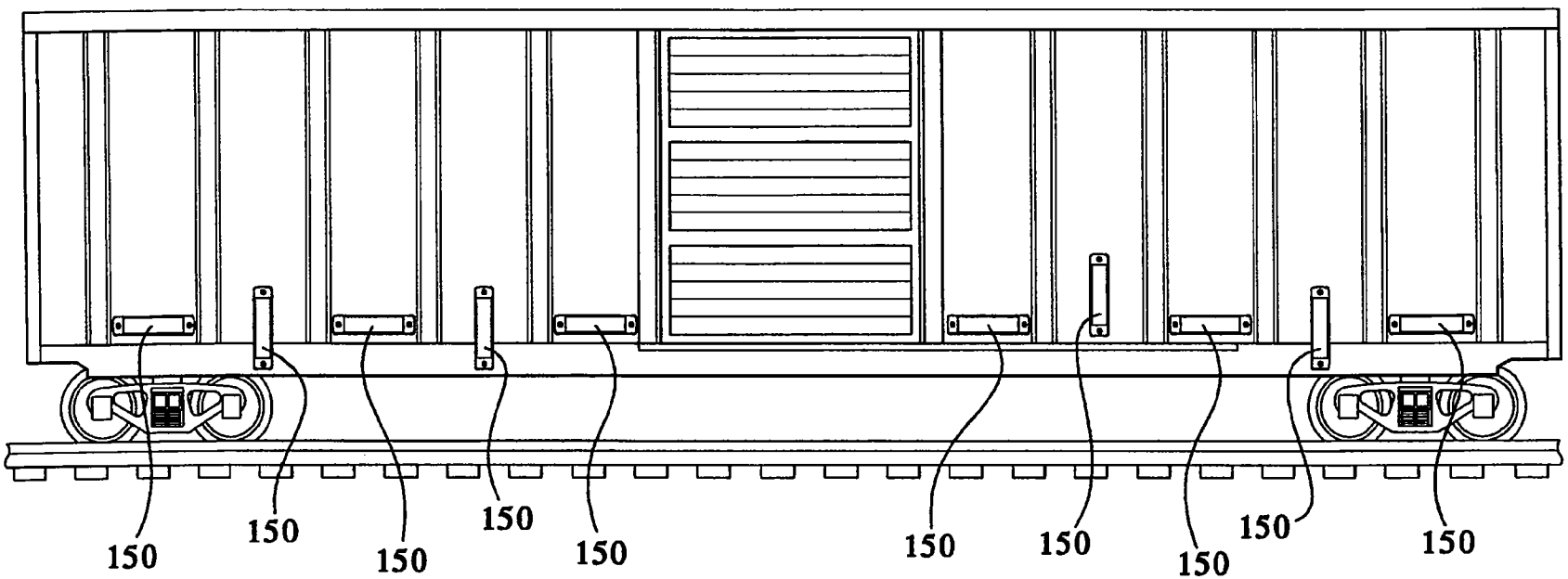
FIG. 9 is a side view of a conventional freight railroad car with a plurality of railroad car reflector apparatus of FIG. 7 mounted along one of the side walls in vertical and horizontal positions.

FIG. 9 illustrates that the reflector apparatus 150 can be placed in a vertical or substantially vertical position relative to the freight railroad car, or in a horizontal or substantially horizontal position relative to the freight railroad car.

The reflector apparatus 150 may be made from any suitable material(s). The mounting member or base 152 may be any suitable type of material such as a molded plastic or a stamped metal. The reflector 154 of the reflector apparatus 150 is in one embodiment a suitable adhesive backed reflective tape such as the reflective tape commercially available as mentioned above. The adhesive backed reflective tape can be placed on the reflector supporter in a controlled environment, as mentioned above, such that maximum adhesive properties are achieved. This provides a great advantage over directly placing the reflective tape on the freight railroad car in the field or in railroad car repair areas where a suitable temperature, climate and other conditions are not always possible to achieve the best adhesion and where the freight railroad cars must be cleaned or painted (as described above) prior to such placement. It should also be appreciated that other suitable types of reflective material may be employed in the freight railroad car reflector apparatus of the present invention.

It should also be appreciated that FIGS. 7 and 8 illustrate that the mounting member or base 152 may have structural supports to provide substantial rigidity to the mounting member or base 152 and the entire reflector apparatus 150. Any suitable structural supports may be employed in the reflector apparatus to provide such rigidity. The supports of the reflector apparatus 150 also define an outer raised border, air deflector or air foil 174 around the entire mounting member 152. This border, air deflector or air foil functions to deflect or redirect wind from engaging the leading edge of the reflector 154. This prevents peeling of the reflector from the mounting member 152. Because the air deflector or air foil is along all of the edges, the air deflector works to protect the leading edge whether the reflector apparatus 150 is placed in a vertical or horizontal position. The air deflector may be along less than all the edges for this embodiment and all of the embodiments disclosed herein as discussed above. This embodiment also provides a recessed reflector receipt area, as can the other various embodiments disclosed herein.

Figure 10:
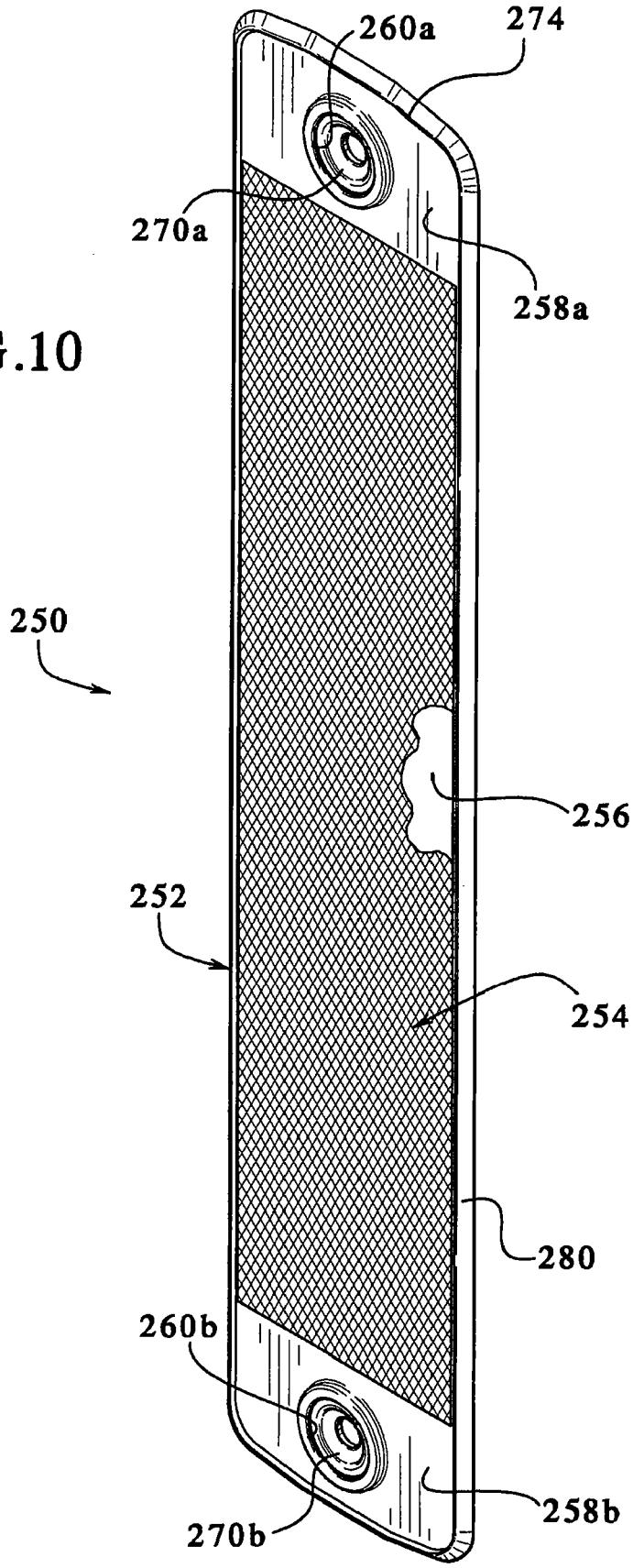
FIG. 10 is a front perspective view of the railroad car reflector apparatus of another embodiment of the present invention with a portion of the reflective material broken away to show the reflector supporter.
Figure 11:
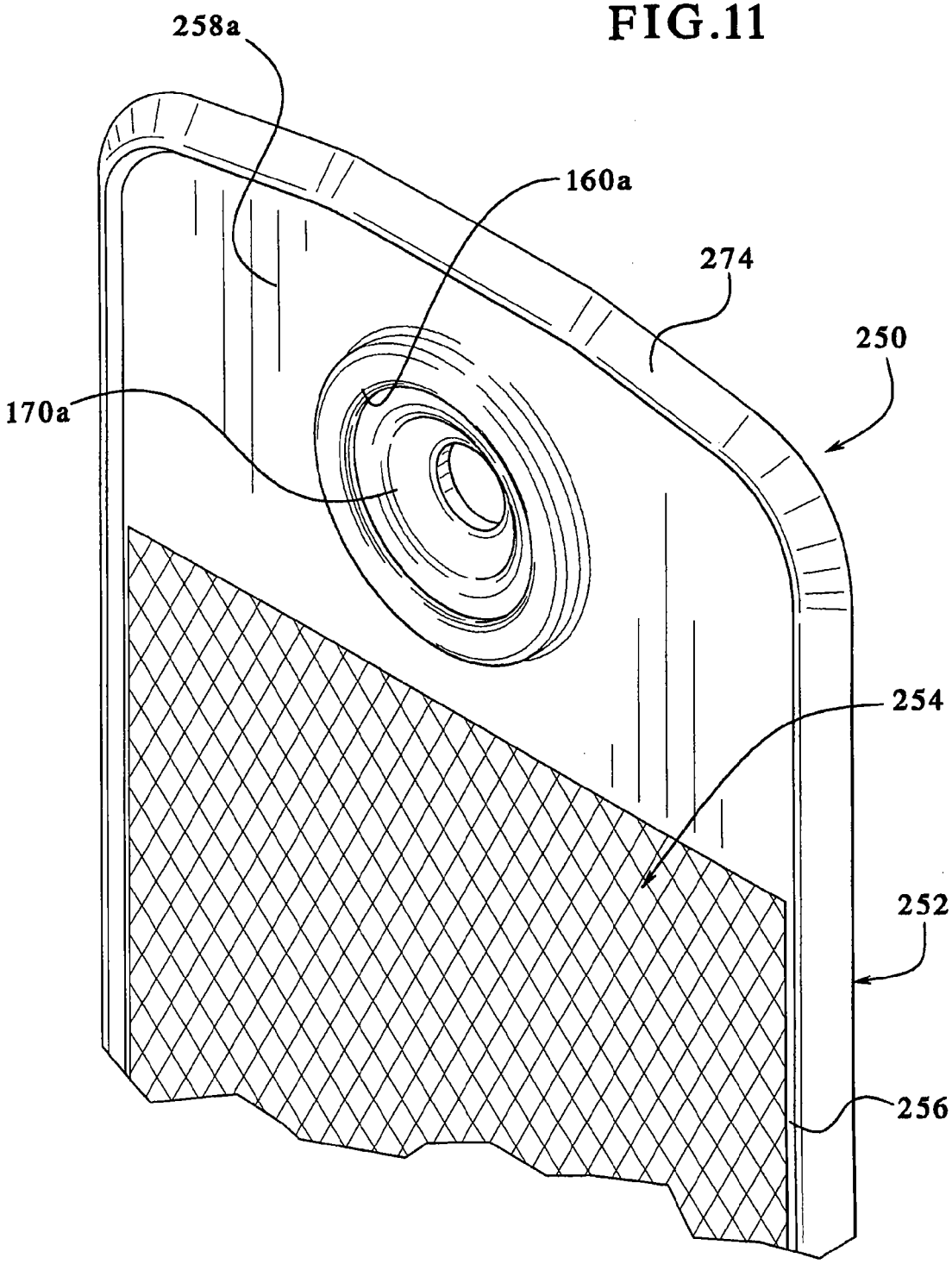
FIG. 11 is an enlarged fragmentary front perspective view of the railroad car reflector apparatus of FIG. 10 showing a weld washer molded in a mounting section.

FIGS. 10 and 11 illustrate another embodiment of the reflector apparatus of the present invention which is generally indicated by numeral 250. The freight railroad car reflector apparatus 250 includes a mounting member or base 252 and a reflective material or reflector 254 attached to the mounting member or base 252. The mounting member or base 252 includes a reflector supporter 256 and mounting sections 258*a* and 258*b* connected to the reflector supporter 256. The mounting sections 258*a* and 258*b* extend transversely from opposing ends of the reflector supporter 256 in this embodiment. The mounting sections 258*a* and 258*b* respectively define mounting apertures 260*a* and 260*b* for facilitating attachment of the reflector apparatus 250 to the freight railroad car. The reflector apparatus 250 includes steel circular weld washers 270*a* and 270*b* molded in or integrally maintained in the mounting sections 258*a* and 258*b*, respectively, as best illustrated in FIG. 11.

The reflector apparatus 250 may be made from any suitable material(s). The mounting member or base may be any suitable type of material such as a molded plastic or a stamped metal. The reflector 254 of the reflector apparatus 250 is in one embodiment a suitable adhesive backed reflective tape such as the reflective tape commercially available as mentioned above. It should also be appreciated that other suitable types of reflective material may be employed in the freight railroad car reflector apparatus of the present invention.

The freight railroad car reflector apparatus 250 is different from the freight railroad car reflector apparatus 150 at least in the shape of the outer border, air deflector or air foil 274. This alternative shape also prevents peeling of the reflector material from the mounting member 252. Because the air deflector or air foil is along all of the edges, the air deflector works to protect the leading edge whether the reflector apparatus 250 is placed in a vertical or horizontal position. It should also be appreciated that the mounting member or base 252 may have other structural supports to provide substantial rigidity to the mounting member or base 252 and the entire reflector apparatus 250. It should be appreciated that any suitable structural supports may be employed in the reflector apparatus to provide such rigidity.

Figure 12:
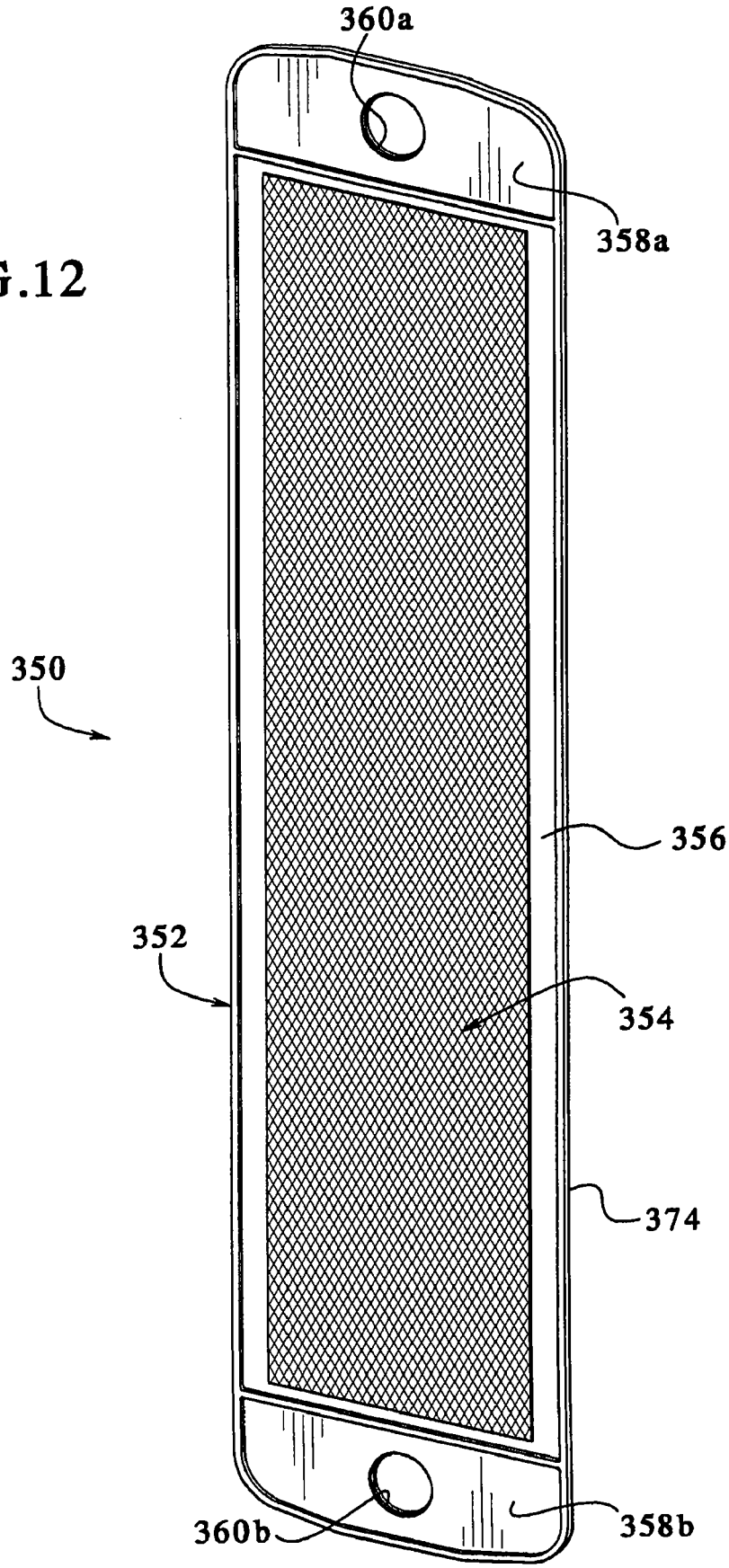
FIG. 12 is a front perspective view of the railroad car reflector apparatus of another embodiment of the present invention.

FIG. 12 illustrates another embodiment of the reflector apparatus of the present invention which is generally indicated by numeral 350. The freight railroad car reflector apparatus 350 includes a mounting member or base 352 and a reflective material or reflector 354 attached to the mounting member or base 352. The mounting member or base 352 includes a reflector supporter 356 and mounting sections 358*a* and 358*b* connected to and extending from opposite ends of the reflector supporter 356. The mounting sections 358*a* and 358*b* respectively define mounting apertures 360*a* and 360*b* for facilitating attachment of the reflector apparatus 350 to the freight railroad car.

The freight railroad car reflector apparatus 350 is different from the freight railroad car reflector apparatus 150 in that fasteners or attachment mechanisms such as the weld washers are not molded into or integrally formed with the mounting sections 358*a* and 358*b*. To install the reflector apparatus 350 on freight railroad car in accordance with one embodiment of the present invention, the installer takes the reflector apparatus 350 and holds it adjacent to the freight railroad car exterior side wall or frame in the appropriate position, positions the attachment mechanism such as a weld washer in one of the mounting apertures and welds the weld washer to the freight railroad car. The installer repeats this process for each mounting aperture. It should be appreciated that in this embodiment and in the other embodiments discussed herein, the number, configuration and arrangement of mounting apertures may vary.

The reflector apparatus 350 may be made from any suitable material(s). The mounting member or base may be any suitable type of material such as a molded plastic or a stamped metal. The reflector 354 of the reflector apparatus 350 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention.

It should also be appreciated that FIG. 12 illustrates that the mounting member or base 352 may have structural supports to provide substantial rigidity to the mounting member or base 352 and the entire reflector apparatus 350. Any suitable structural supports may be employed in the reflector apparatus to provide such rigidity. The supports of the reflector apparatus 350 also define an outer raised border, air deflector or air foil 374 around the entire mounting member 352. This border, air deflector or air foil 374 functions to deflect or redirect wind from engaging the leading edge of the reflector 354. This prevents peeling of the reflector material from the mounting member 352. Because the air deflector or air foil is along all of the edges, the air deflector works to protect the leading edge whether the reflector apparatus 350 is placed in a vertical or horizontal position.

Figure 13:
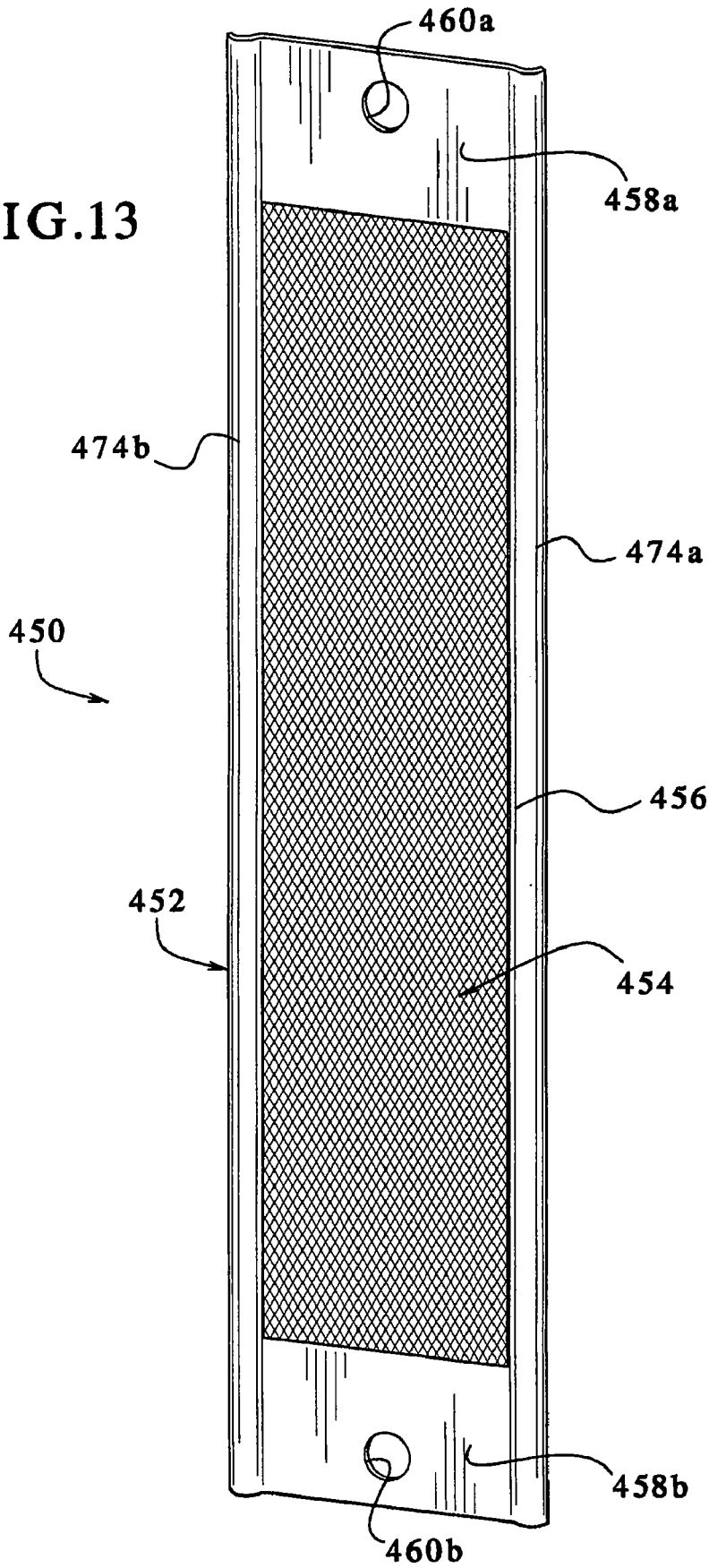
FIG. 13 is a front perspective view of the railroad car reflector apparatus of another embodiment of the present invention.

FIG. 13 illustrates another embodiment of the reflector apparatus of the present invention which is generally indicated by numeral 450. The freight railroad car reflector apparatus 450 includes a mounting member or base 452 and a reflector 454 attached to the mounting member or base 452. The mounting member or base 452 includes a reflector supporter 456 and mounting sections 458*a* and 458*b* connected to the reflector supporter 456. The mounting sections 458*a* and 458*b* respectively define mounting apertures 460*a* and 460*b* for facilitating attachment of the reflector apparatus 450 to the freight railroad car.

The freight railroad car reflector apparatus 450 is different from the freight railroad car reflector apparatus 150 in that the weld washers are not molded into the mounting sections 458*a* and 458*b*. The shapes of the mounting sections are also different for the reason discussed below.

The reflector apparatus 450 may be made from any suitable material. The mounting member may be any suitable type of material such as a molded plastic or a stamped metal. In one embodiment, the mounting member 452 is specifically configured to be extruded. The mounting apertures 460*a* and 460*b* are stamped in the mounting sections 458*a* and 458*b*. In the extrusion process, several mounting members are formed in a single extrusion and are then cut or separated. This separation process forms the straight edge along each end of the mounting member. The structure illustrated has the air deflectors/structural supports 474*a* and 474*b* along opposing sides of the mounting member as discussed below. It should be appreciated that a different embodiment may be extruded in a transverse direction to provide the air deflectors/structural supports at the ends of the mounting members.

The reflector 454 of the reflector apparatus 450 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention.

It should be appreciated that FIG. 13 illustrates the reflector apparatus 450 define air deflectors or air foils 474*a* and 474*b* on opposite sides of the mounting member 452. These air deflectors or air foils functions to deflect or redirect wind from engaging the leading edge of the reflector 454 when the reflector is mounted in a vertical or substantially vertical position. This prevents peeling of the reflector from the mounting member 452. In this illustrated embodiment, the air foils or air deflector are semi-circular; however, it should be appreciated that they may be any suitable shape. It should also be appreciated as mentioned above that the air deflectors may be positioned such that the reflector apparatus can be positioned horizontally.

Figure 14:
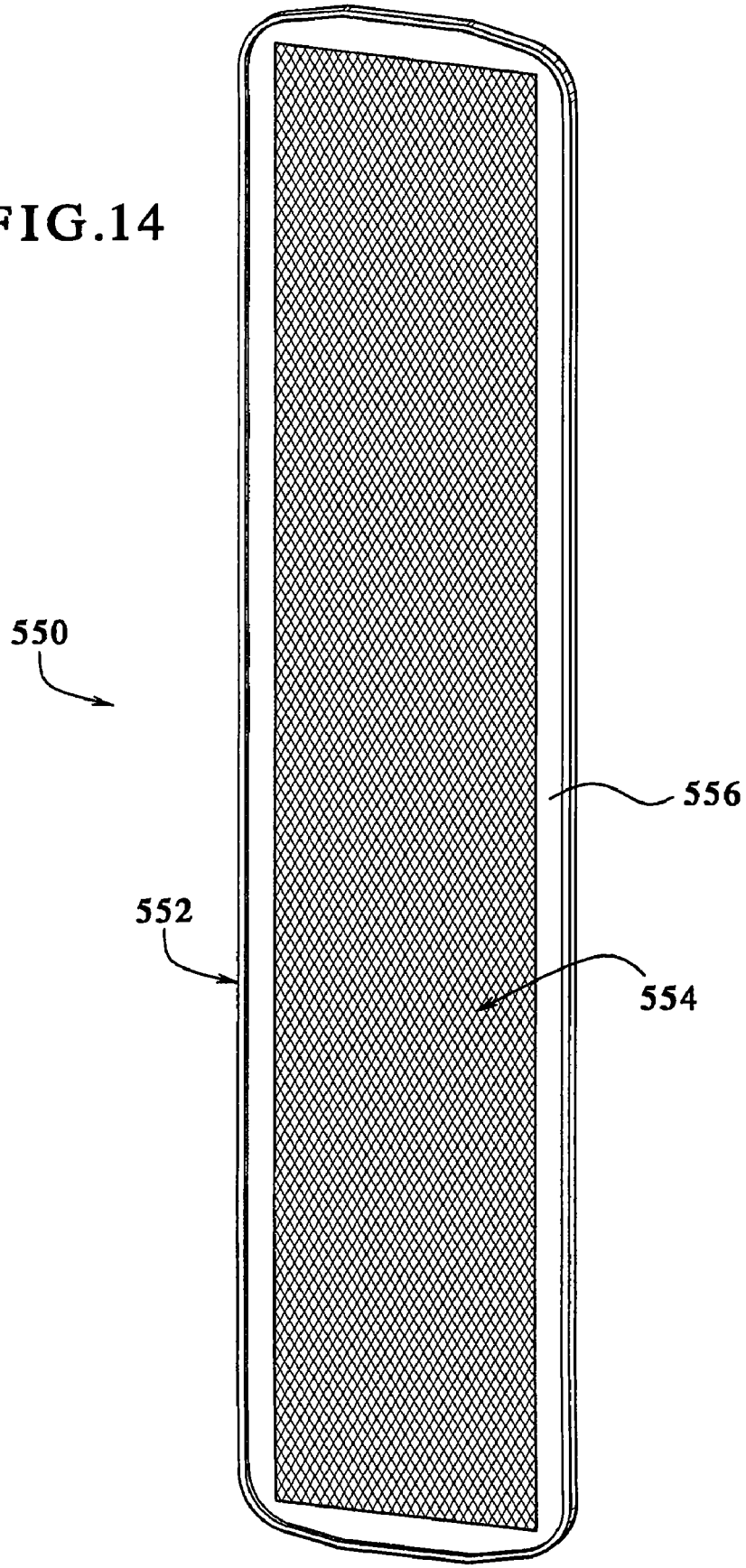
FIG. 14 is a front perspective view of the railroad car reflector apparatus of another embodiment of the present invention.
Figure 15:
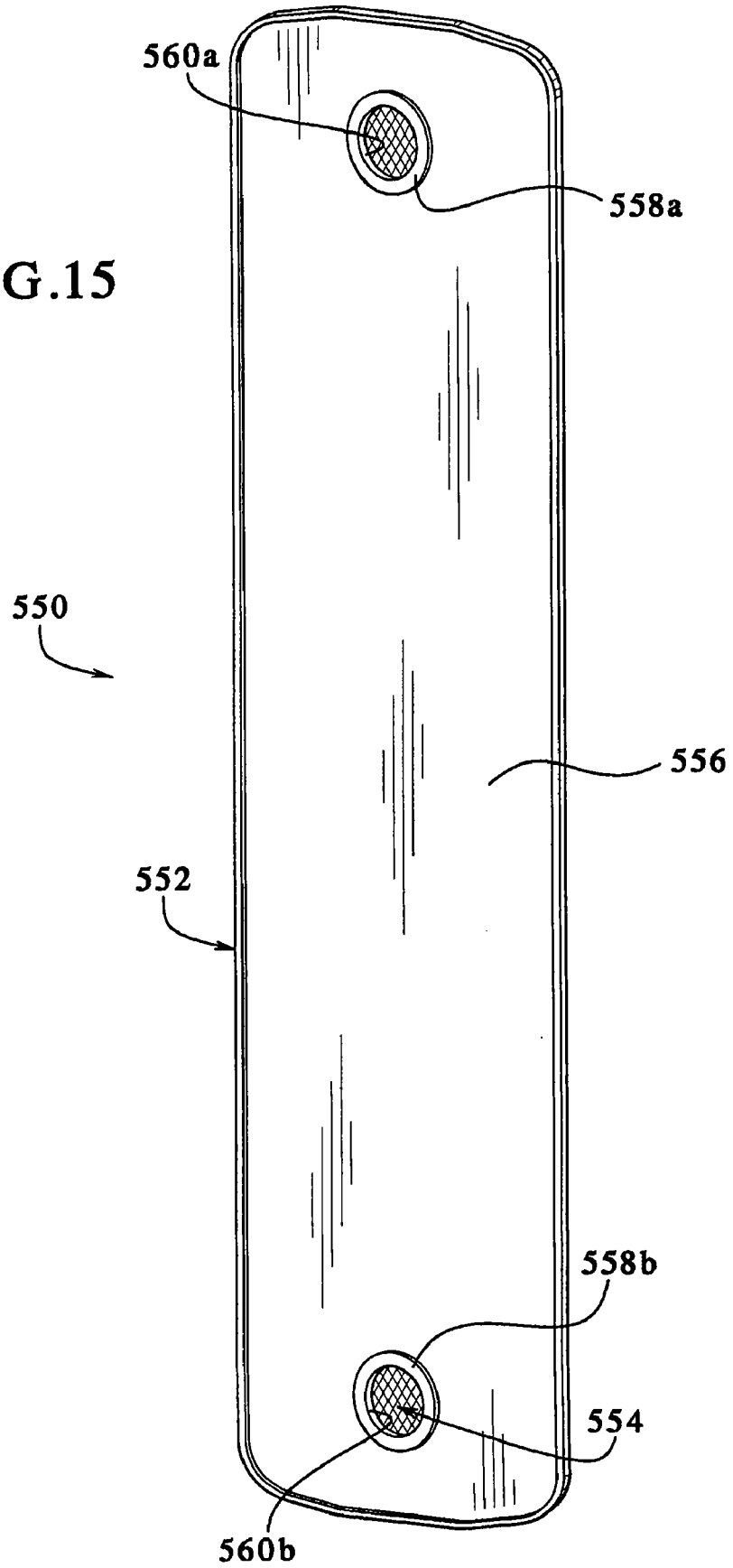
FIG. 15 is a rear perspective view of the railroad car reflector apparatus of FIG. 14.

FIGS. 14 and 15 illustrate another embodiment of the reflector apparatus of the present invention which is generally indicated by numeral 550. The freight railroad car reflector apparatus 550 includes a mounting member or base 552 and a reflector 554 attached to the mounting member or base 552. The mounting member or base 552 includes a reflector supporter 556 and mounting sections 558*a* and 558*b* connected to the back of and extending from the reflector supporter 556 as best illustrated in FIG. 15.

The mounting sections 558*a* and 558*b* respectively define mounting apertures 560*a* and 560*b* for facilitating attachment of the reflector apparatus 550 to the freight railroad car as discussed below.

The reflector apparatus 550 may be made from any suitable material(s). The mounting member or base may be any suitable type of material such as a molded plastic or a stamped metal. The reflector 554 of the reflector apparatus 550 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention.

This reflector apparatus is provided in three separate parts for installation. More particularly, the reflector is not attached to the reflector supporter 556 of the mounting member 552 until installation. The installer uses the weld washers to attach the mounting member 552 to the freight railroad car and then attaches the reflector 554 to the reflector supporter 556. The reflector 556 thus covers the weld washers.

It should also be appreciated that FIGS. 14 and 15 illustrate that the mounting member or base 552 may have structural supports to provide substantial rigidity to the mounting member or base 552 and the entire reflector apparatus 550. Any suitable structural supports may be employed in the reflector apparatus to provide such rigidity. The supports of the reflector apparatus 550 also define an outer raised border, air deflector or air foil around the entire mounting member 552. This border, air deflector or air foil functions to deflect or redirect wind from engaging the leading edge of the reflector 554. This prevents peeling of the reflector from the mounting member 552. Because the air deflector or air foil is along all of the edges, the air deflector works to protect the leading edge whether the reflector apparatus 550 is placed in a vertical or horizontal position.

Figure 16:
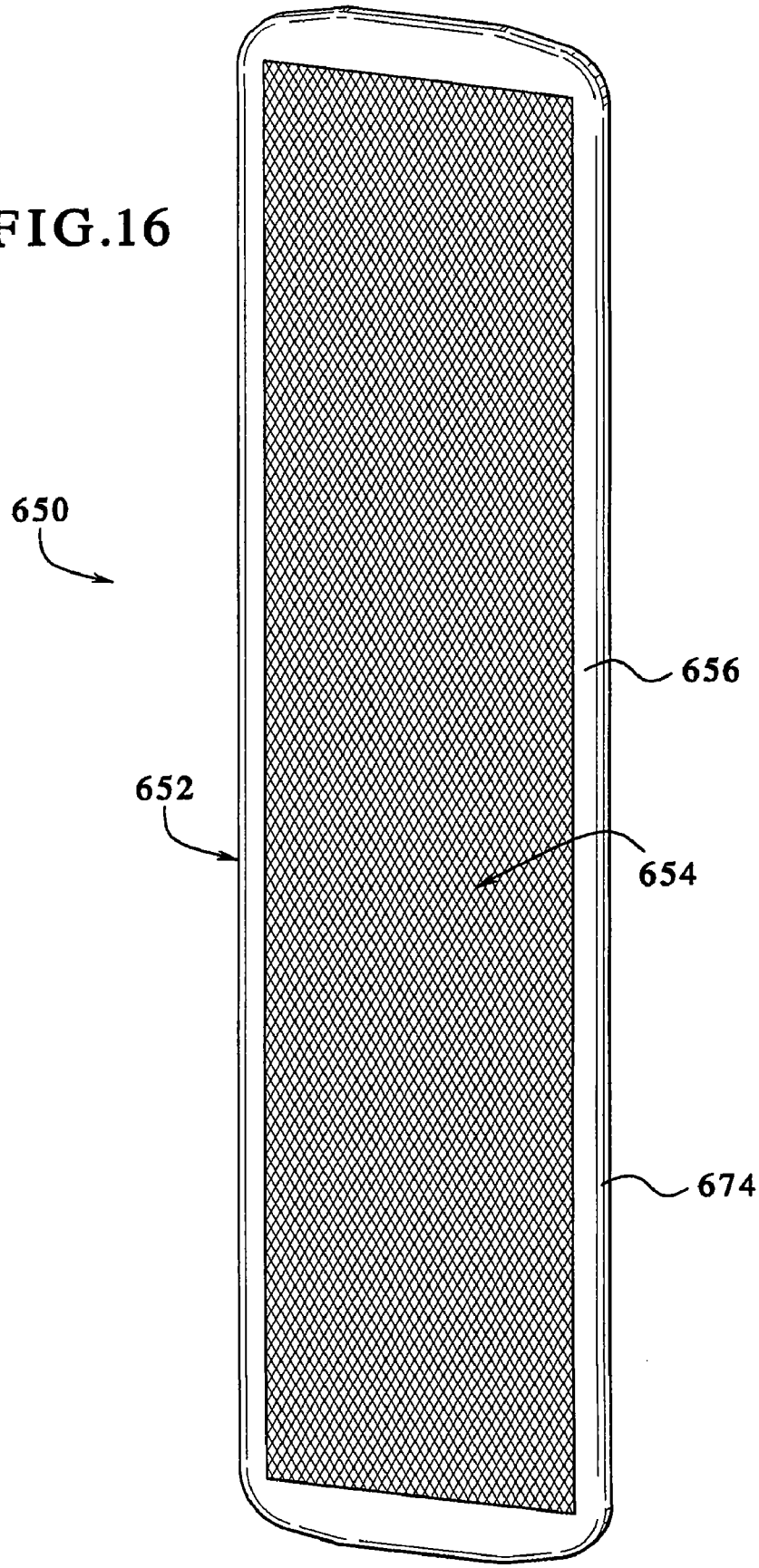
FIG. 16 is a front perspective view of the railroad car reflector apparatus of another embodiment of the present invention.
Figure 17:
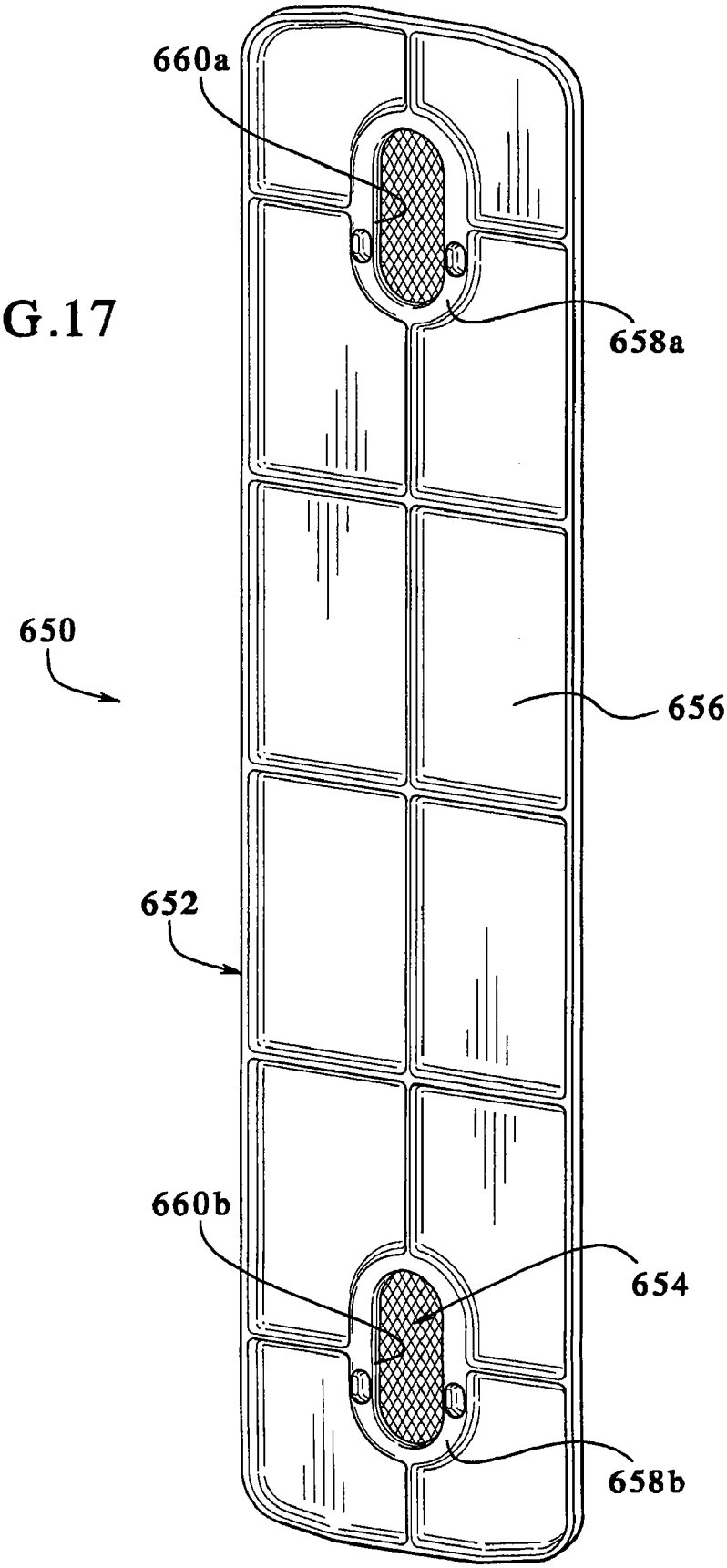
FIG. 17 is a rear perspective view of the railroad car reflector apparatus of FIG. 16.

FIGS. 16 and 17 illustrate another embodiment of the reflector apparatus of the present invention which is generally indicated by numeral 650. The freight railroad car reflector apparatus 650 includes a mounting member or base 652 and a reflector 654 attached to the mounting member or base 652. The mounting member or base 652 includes a reflector supporter 656 and mounting sections 658*a* and 658*b* connected to the reflector supporter 656 as best illustrated in FIG. 17.

The mounting sections 658*a* and 658*b* respectively define oval mounting apertures 660*a* and 660*b* for facilitating attachment of the reflector apparatus 650 to the freight railroad car as discussed below. It should be appreciated that in this embodiment and the other embodiments disclosed herein, the shape of the apertures may vary.

The reflector apparatus 650 may be made from any suitable material(s). The mounting member or base may be any suitable type of material such as a molded plastic or a stamped metal. The reflector 654 of the reflector apparatus 650 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention.

Similar to the embodiment of FIGS. 14 and 15, this reflector apparatus 650 is provided in three separate parts for installation. The reflector 654 is not attached to the reflector supporter 656 of the mounting member 652 until installation. The installer uses the weld washers to attach the mounting member 652 to the freight railroad car and then attaches the reflector 654 to the reflector supporter 656. More particularly, the mounting sections 658*a* and 658*b* respectively have mounting apertures and weld washer holders or tabs which allow an installer to place the weld washers in the apertures, allow the weld washer to slide downwardly and be held or maintained by the tabs during the welding process. The reflector 656 thus covers the weld washers. In an alternative embodiment, the present method and apparatus contemplates that the weld washers or other suitable attachment mechanisms would be preinstalled in the mounting sections.

It should also be appreciated that FIGS. 16 and 17 illustrate that the mounting member or base 652 may have structural supports to provide substantial rigidity to the mounting member or base 652 and the entire reflector apparatus 650. Any suitable structural supports may be employed in the reflector apparatus to provide such rigidity. The supports of the reflector apparatus 650 also define an outer raised border, air deflector or air foil 674 around the entire or portions of mounting member 652. This border, air deflector or air foil functions to deflect or redirect wind from engaging the leading edge of the reflector 654. This prevents peeling of the reflector from the mounting member 652. Because in one embodiment the air deflector or air foil is along all of the edges, the air deflector works to protect the leading edge whether the reflector apparatus 650 is placed in a vertical or horizontal position.

Figure 18:
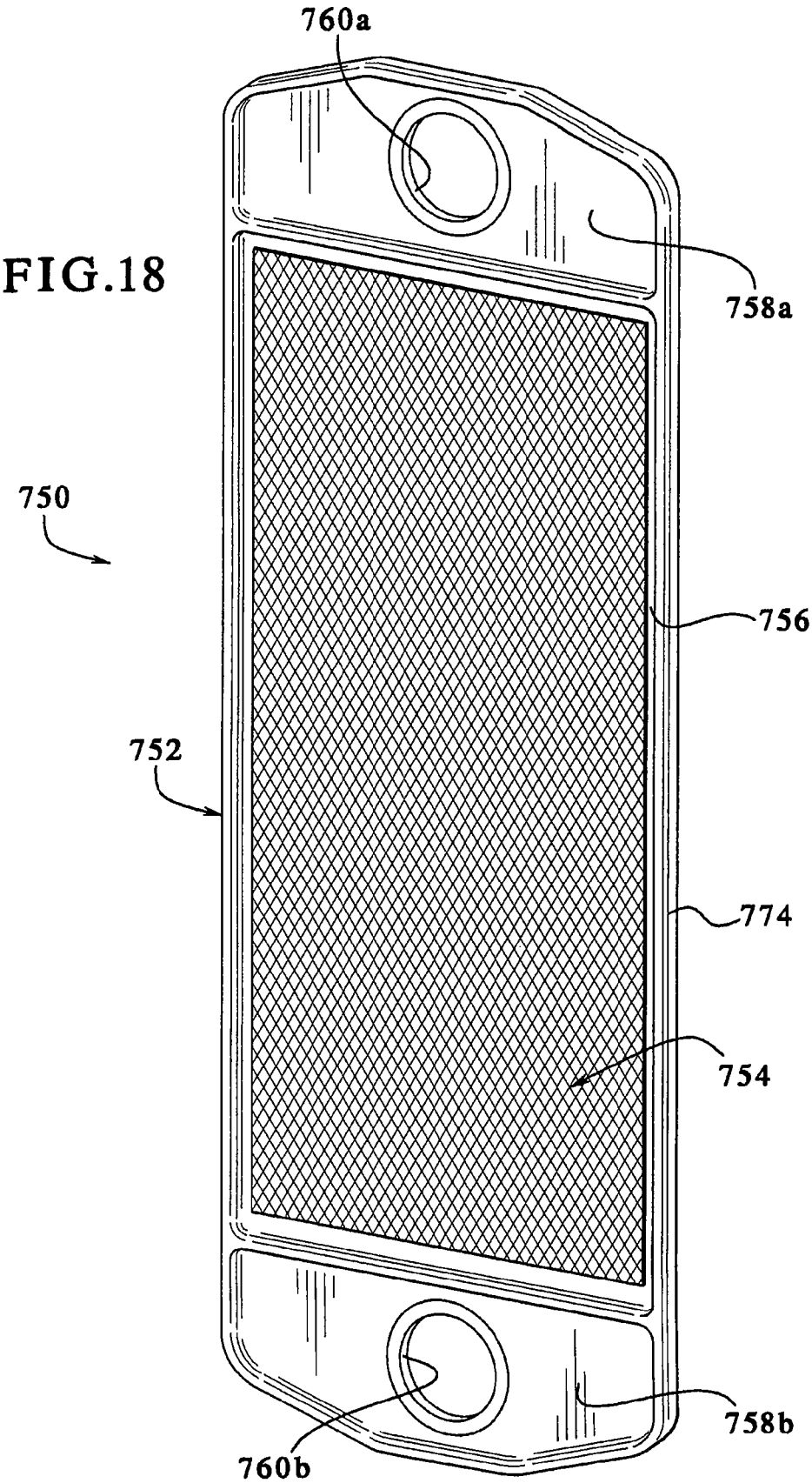
FIG. 18 is a front perspective view of the railroad car reflector apparatus of another embodiment of the present invention.

FIG. 18 illustrates another embodiment of the reflector apparatus of the present invention which is generally indicated by numeral 750. The freight railroad car reflector apparatus 750 includes a mounting member or base 752 and a reflector 754 attached to the mounting member or base 752. The mounting member or base 752 includes a reflector supporter 756 and mounting sections 758*a* and 758*b* connected to the reflector supporter 756. The mounting member or base 752 includes a reflector supporter 756 and mounting sections 758*a* and 758*b* connected to the reflector supporter 756.

The mounting sections 758*a* and 758*b* respectively define mounting apertures 760*a* and 760*b* for facilitating attachment of the reflector apparatus 750 to the freight railroad car. The reflector support 756 in this embodiment has a recessed area for receiving the reflector 754.

The reflector apparatus 750 may be made from any suitable material(s). The mounting member or base may be any suitable type of material such as a molded plastic or a stamped metal. The reflector 754 of the reflector apparatus 750 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention.

It should also be appreciated that FIG. 18 illustrates that the mounting member or base 752 may have structural supports to provide substantial rigidity to the mounting member or base 752 and the entire reflector apparatus 750. Any suitable structural supports may be employed in the reflector apparatus to provide such rigidity. The supports of the reflector apparatus 750 also defines an outer raised border, air deflector or air foil 774 around the entire mounting member 752. This border, air deflector or air foil functions to deflect or redirect wind from engaging the leading edge of the reflector 754. This prevents peeling of the reflector from the mounting member 752. Because the air deflector or air foil is along all of the edges, the air deflector works to protect the leading edge whether the reflector apparatus 750 is placed in a vertical or horizontal position.

Figure 19:
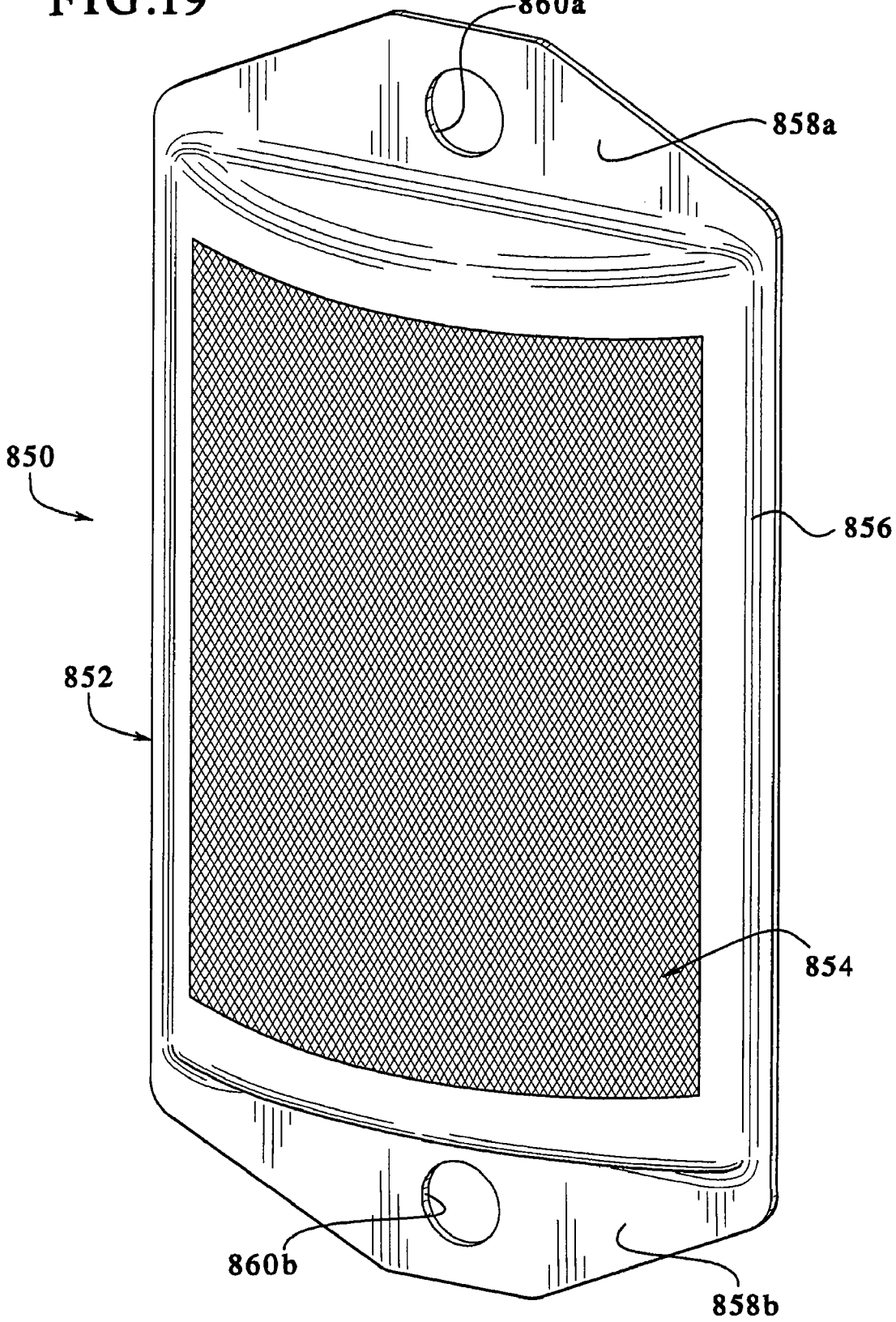
FIG. 19 is a front perspective view of the railroad car reflector apparatus of another embodiment of the present invention.
Figure 20:
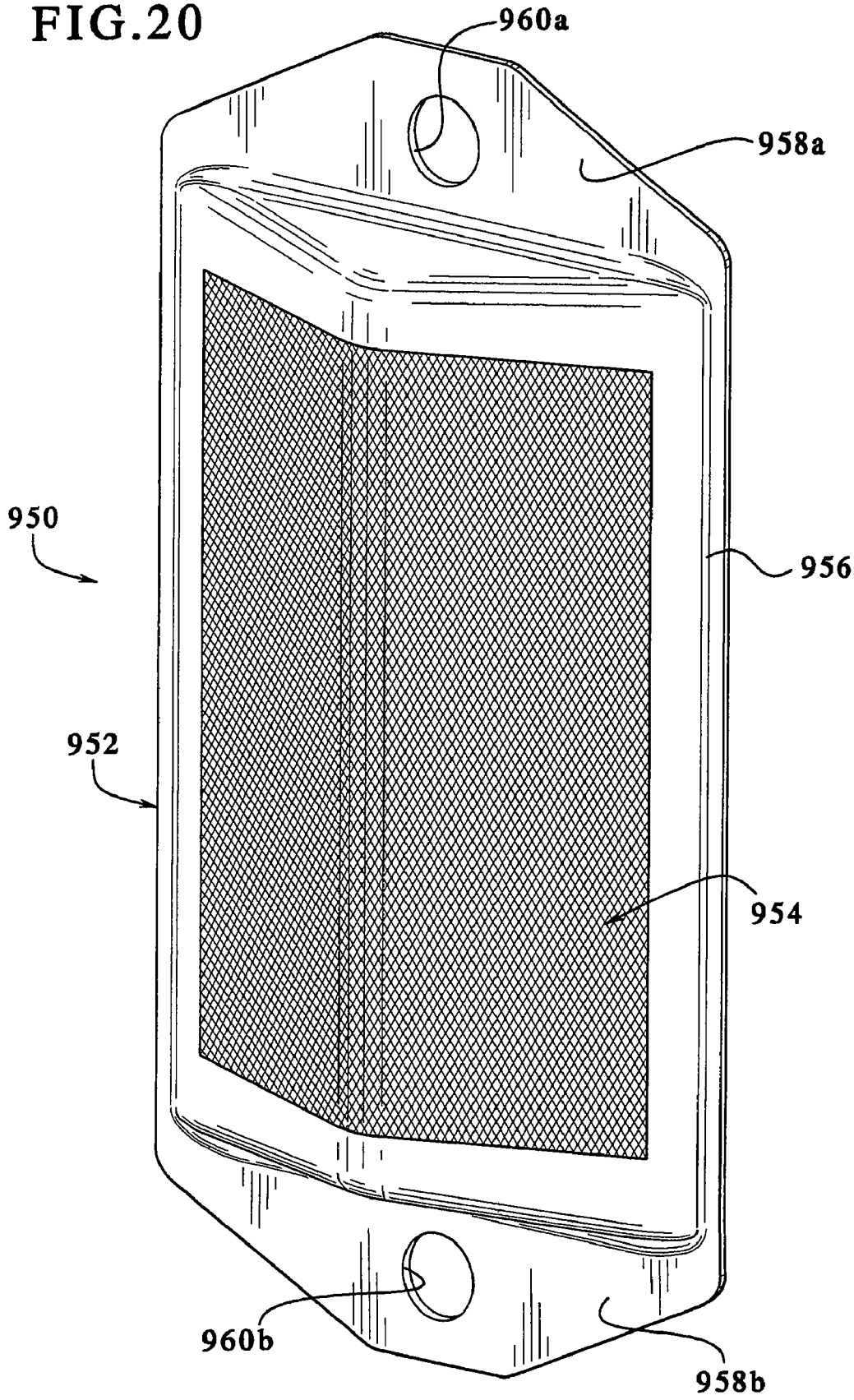
FIG. 20 is a front perspective view of the railroad car reflector apparatus of another embodiment of the present invention.
Figure 21:
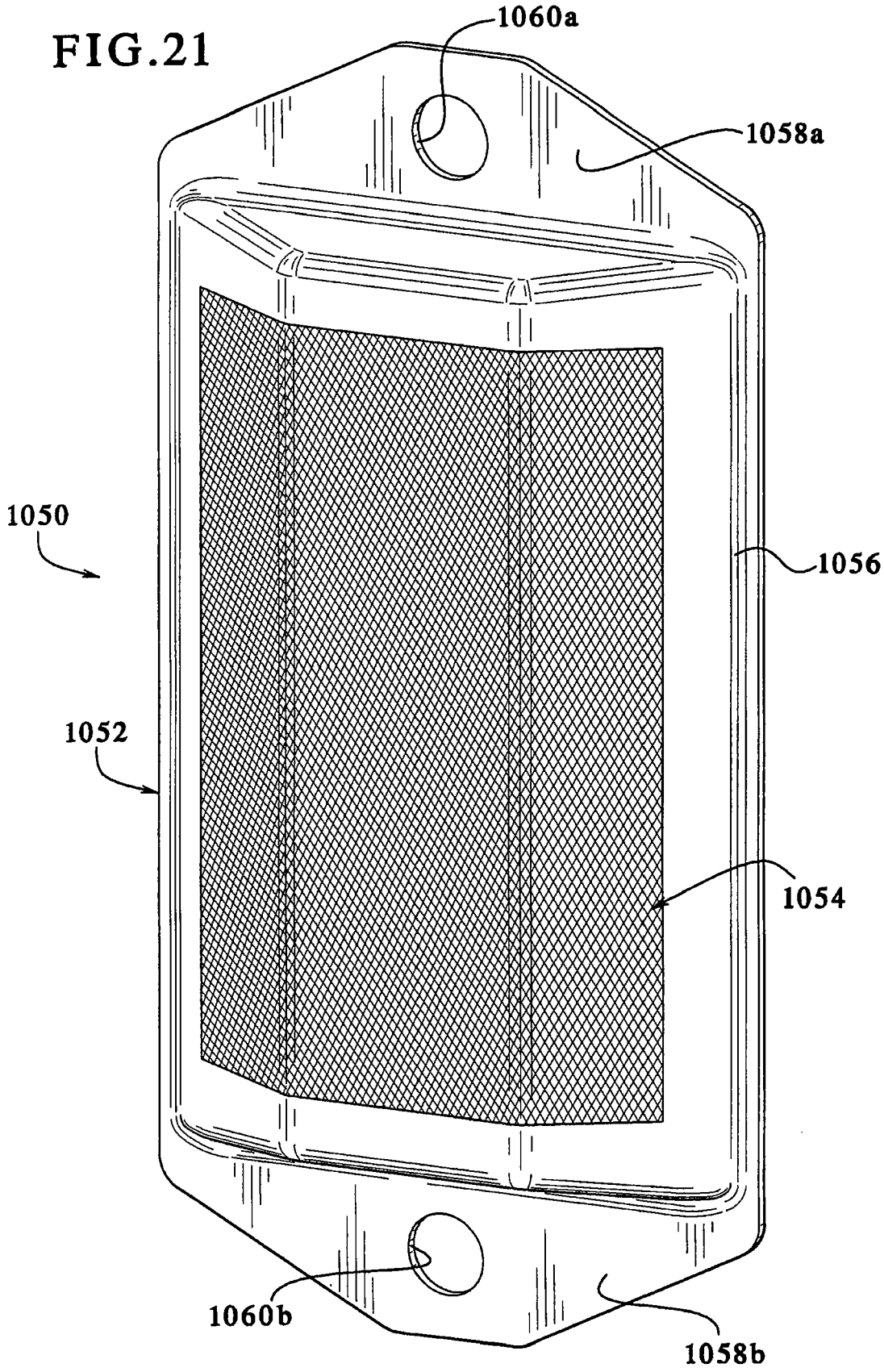
FIG. 21 is a front perspective view of the railroad car reflector apparatus of another embodiment of the present invention.
Figure 22:
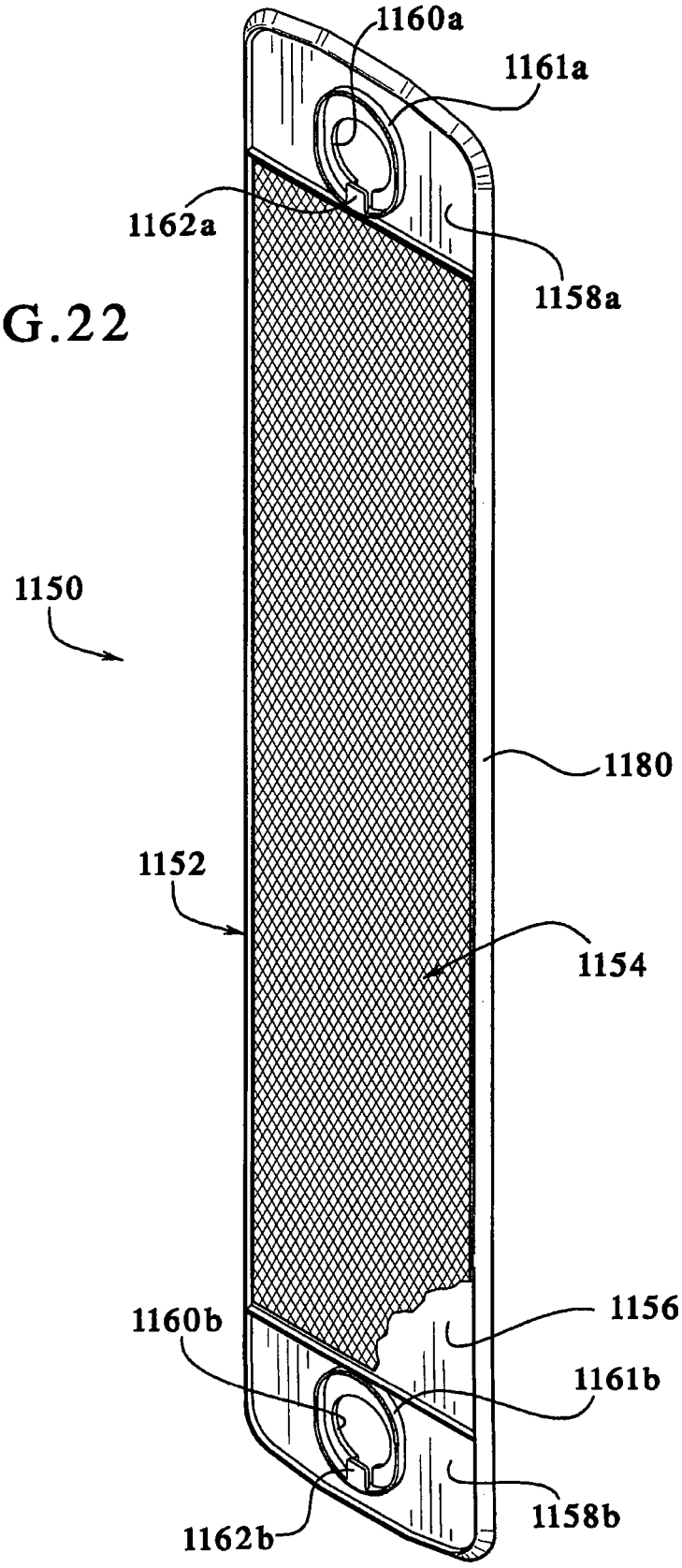
FIG. 22 is a front perspective view of the railroad car reflector apparatus of another embodiment of the present invention with a portion of the reflective material broken away to show the reflector supporter, and which is configured to removably hold a plurality of weld washers in the upper and lower mounting sections.
Figure 23:
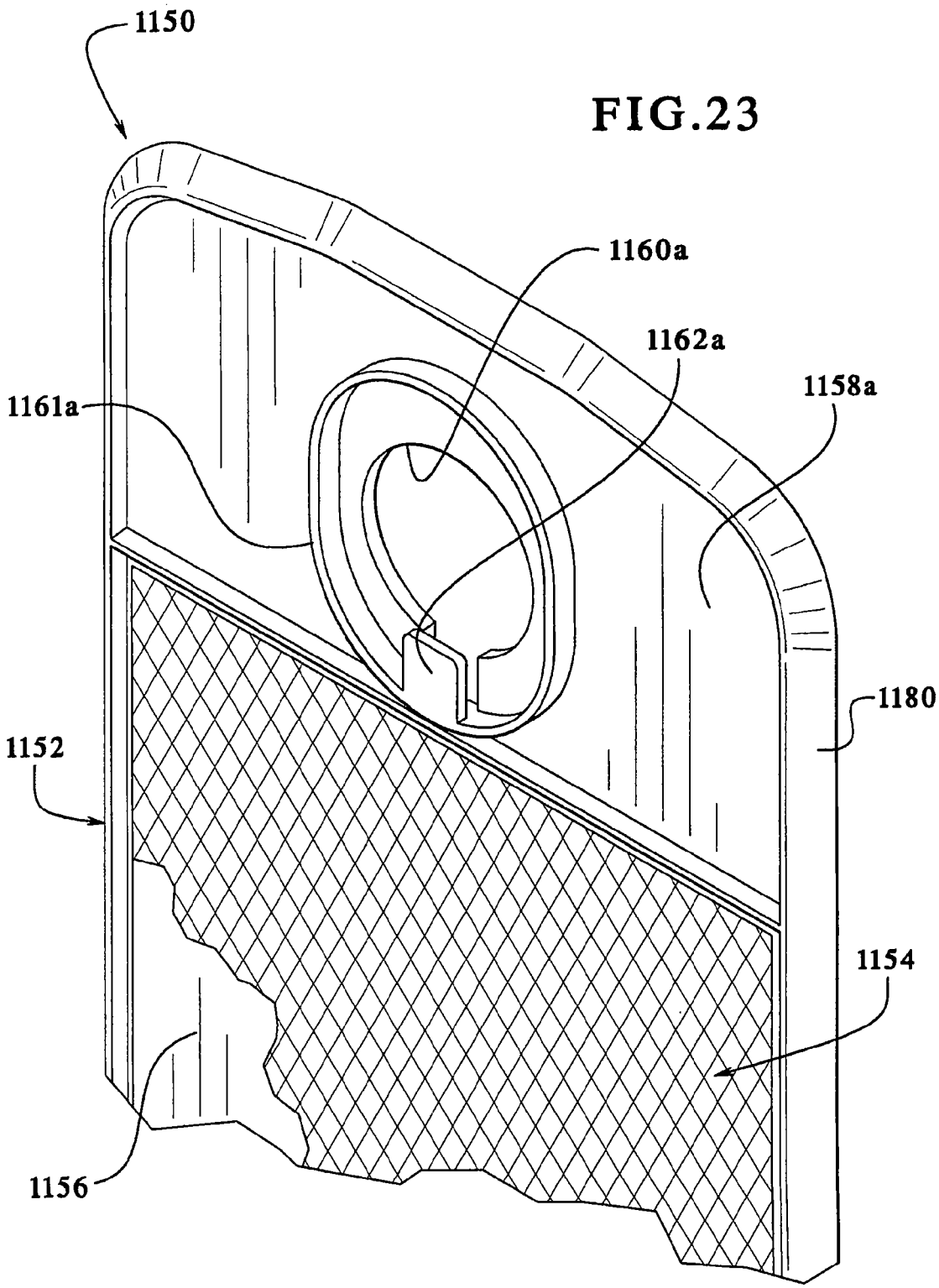
FIG. 23 is an enlarged fragmentary front perspective view of the upper mounting section of the railroad car reflector apparatus of the embodiment of FIG. 22 with a portion of the reflective material broken away to show the reflector supporter.
Figure 24:
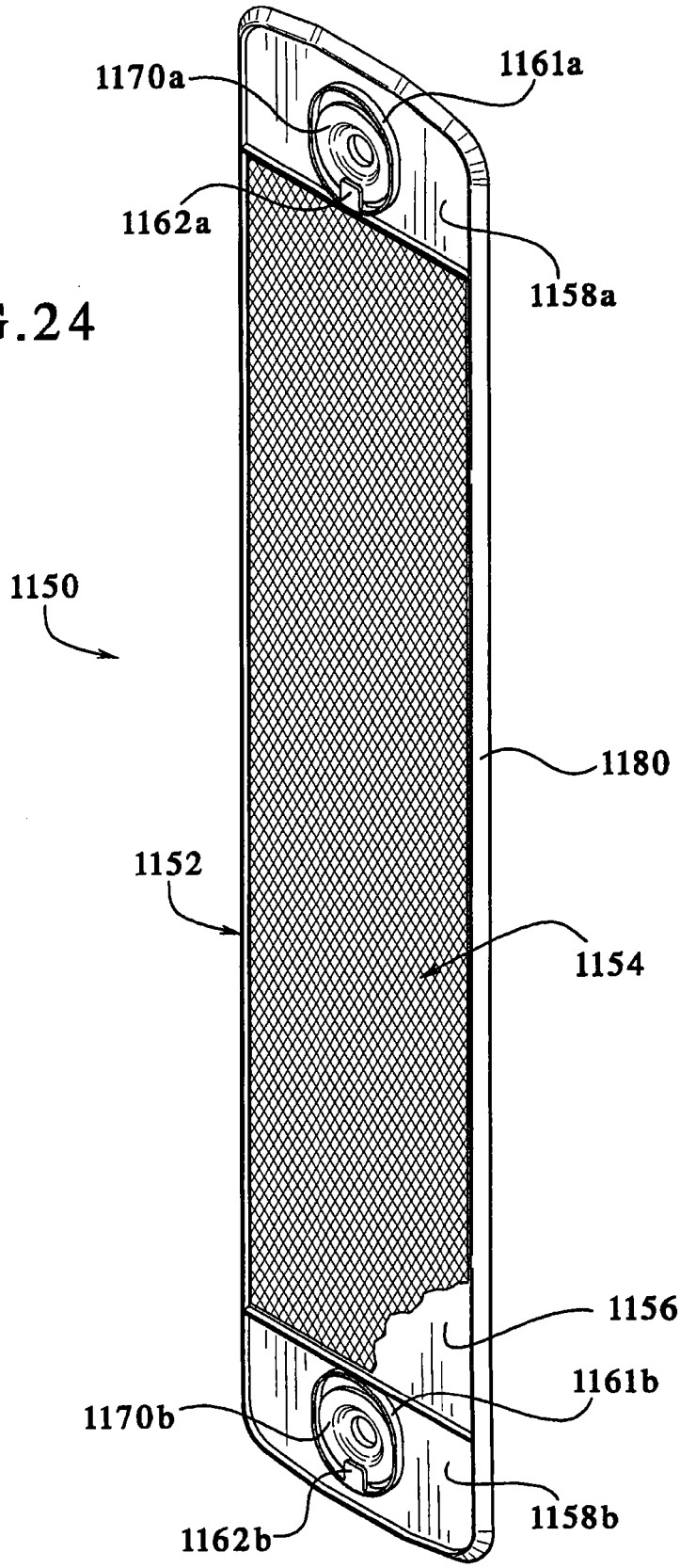
FIG. 24 is a front perspective view of the railroad car reflector apparatus of the embodiment of FIG. 22 with a portion of the reflective material broken away to show the reflector supporter, showing the weld washers mounted in the upper and lower mounting sections.
Figure 25:
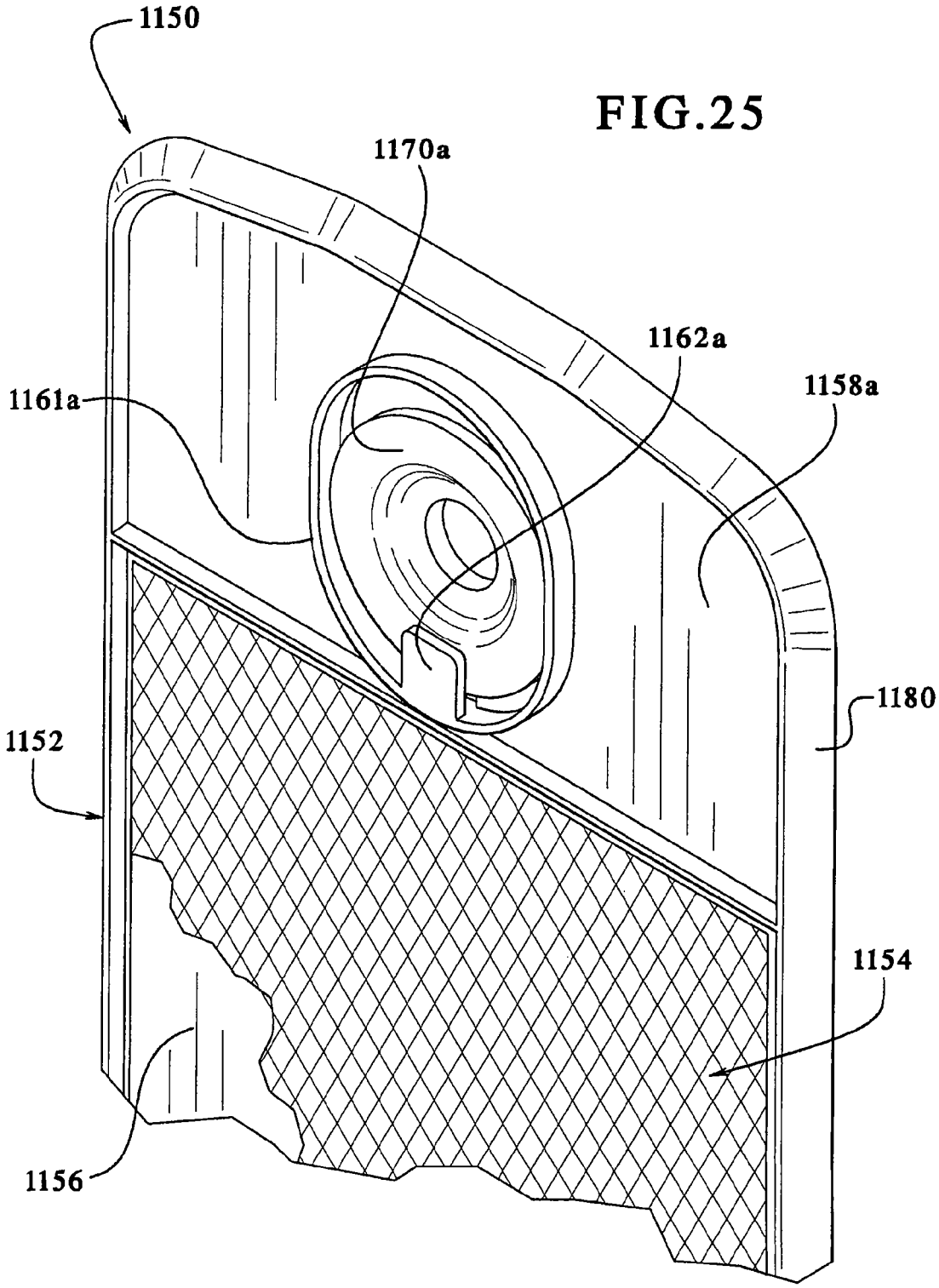
FIG. 25 is an enlarged fragmentary front perspective view of the upper mounting section of the railroad car reflector apparatus of the embodiment of FIG. 22 with a portion of the reflective material broken away to show the reflector supporter, showing a weld washer mounted in the upper mounting section.

FIGS. 19, 20 and 21 illustrate additional alternative embodiments of the present invention. Generally, they illustrate that the reflector support can be formed extending from the mounting member to provide reflection at greater angles. This provides greater ability to reflect light.

More specifically, FIG. 19 illustrates another embodiment of the reflector apparatus of the present invention which is generally indicated by numeral 850. The freight railroad car reflector apparatus 850 includes a mounting member or base 852 and a reflector 854 attached to the mounting member or base 852. The mounting member or base 852 includes a curved or semi-circular reflector supporter 856 and mounting sections 858*a* and 858*b* connected to the reflector supporter 856. The mounting member or base 852 includes a reflector supporter 856 and mounting sections 858*a* and 858*b* connected to the reflector supporter 856. The mounting sections 858*a* and 858*b* respectively define mounting apertures 860*a* and 860*b* for facilitating attachment of the reflector apparatus 850 to the freight railroad car.

The reflector apparatus 850 may be made from any suitable material(s). The mounting member or base may be any suitable type of material such as a molded plastic or a stamped metal. The reflector 854 of the reflector apparatus 850 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention. Specifically, in this embodiment, the reflector may be a plastic reflector supported by the reflector supporter.

It should also be appreciated that FIG. 19 illustrates that the mounting member or base 852 may have structural supports to provide substantial rigidity to the mounting member or base 852, the reflector supporter and the entire reflector apparatus 850. Any suitable structural supports may be employed in the reflector apparatus to provide such rigidity. It should also be appreciated that the reflector can be mounted with the edges protected by the reflector supporter to prevent peeling of the reflector from the mounting member 852.

FIG. 20 illustrates another embodiment of the reflector apparatus of the present invention which is generally indicated by numeral 950. The freight railroad car reflector apparatus 950 includes a mounting member or base 952 and a reflector 954 attached to the mounting member or base 952. The mounting member or base 952 includes a somewhat triangular reflector supporter 956 and mounting sections 958*a* and 958*b* connected to the reflector supporter 956. The mounting member or base 952 includes a reflector supporter 956 and mounting sections 958*a* and 958*b* connected to the reflector supporter 956.

The mounting sections 958*a* and 958*b* respectively define mounting apertures 960*a* and 960*b* for facilitating attachment of the reflector apparatus 950 to the freight railroad car.

The reflector apparatus 950 may be made from any suitable material(s). The mounting member or base may be any suitable type of material such as a molded plastic or a stamped metal. The reflector 954 of the reflector apparatus 950 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention. Specifically, in this embodiment, the reflector may be a plastic reflector supported by the reflector supporter.

It should also be appreciated that FIG. 20 illustrates that the mounting member or base 952 may have structural supports to provide substantial rigidity to the mounting member or base 952, the reflector supporter and the entire reflector apparatus 950. Any suitable structural supports may be employed in the reflector apparatus to provide such rigidity. It should also be appreciated that the reflector can be mounted with the edges protected by the reflector supporter to prevent peeling of the reflector from the mounting member 952.

FIG. 21 illustrates another embodiment of the reflector apparatus of the present invention which is generally indicated by numeral 1050. The freight railroad car reflector apparatus 1050 includes a mounting member or base 1052 and a reflector 1054 attached to the mounting member or base 1052. The mounting member or base 1052 includes a somewhat trapezoidal reflector supporter 1056 and mounting sections 1058*a* and 1058*b* connected to the reflector supporter 1056. The mounting member or base 1052 includes a reflector supporter 1056 and mounting sections 1058*a* and 1058*b* connected to the reflector supporter 1056. The mounting sections 1058*a* and 1058*b* respectively define mounting apertures 1060*a* and 1060*b* for facilitating attachment of the reflector apparatus 1050 to the freight railroad car.

The reflector apparatus 1050 may be made from any suitable material(s). The mounting member or base may be any suitable type of material such as a molded plastic or a stamped metal. The reflector 1054 of the reflector apparatus 1050 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention. Specifically, in this embodiment, the reflector may be a plastic reflector supported by the reflector supporter.

It should also be appreciated that FIG. 21 illustrates that the mounting member or base 1052 may have structural supports to provide substantial rigidity to the mounting member or base 1052, the reflector supporter and the entire reflector apparatus 1050. It should be appreciated that any suitable structural supports may be employed in the reflector apparatus to provide such rigidity. It should also be appreciated that the reflector can be mounted with the edges protected by the reflector supporter to prevent peeling of the reflector from the mounting member 1052.

It should be appreciated that in any of the embodiments of the present invention, the reflector apparatus can include a cover mounted over the reflector or the reflector and mounting member to protect the surface of the reflector from scratching or other damage. In one such embodiment, the cover is a clear plastic sheet. In another embodiment the cover includes a clear material molded around the reflector. Other suitable covers may be employed in the reflector apparatus.

FIGS. 22, 23, 24 and 25 illustrate another embodiment of the reflector apparatus of the present invention which is generally indicated by numeral 1150. The freight railroad car reflector apparatus 1150 includes a mounting member or base 1152 and a reflector 1154 attached to the mounting member or base 1152. The mounting member or base 1152 includes a reflector supporter 1156 and mounting sections 1158*a* and 1158*b* connected to and extending from opposing ends of the reflector supporter 1156. The reflector support 1156 in this embodiment has a recessed area for receiving the reflector 1154.

The mounting sections 1158*a* and 1158*b* respectively define mounting apertures 1160*a* and 1160*b* configured for facilitating attachment of the reflector apparatus 1150 to the freight railroad car. The mounting apertures 1160*a* and 1160*b* are suitably sized to receive a portion of weld washers 1170*a* and 1170*b*. A portion of each of the weld washers 1170*a* and 1170*b* respectively extend beyond the mounting apertures 1160*a* and 1160*b* to provide a sufficient purchase area to enable the weld washers to maintain the mounting sections 1158*a* and 1158*b* (and the entire reflector apparatus 1150) to the freight railroad car when the weld washers are welded to the freight railroad car.

The mounting sections 1158*a* and 1158*b* have weld washer guides 1161*a* and 1161*b* in the form of outwardly extending guide walls, each of which has a first wall portion on a first side of mounting aperture 1160*a* or 1160*b*, and a second wall portion on a second side of mounting aperture 1160*a* or 1160*b*; and weld washer holders or tabs 1162*a* and 1162*b*, each of which extends from a free end of at least one of the first and second wall portions, i.e. extending from the top edge of guide 1161*a* or 1161*b*. The mounting sections 1158*a* and 1158*b* also have curved walls that are located inside and perpendicular to guides 1161*a* and 1161*b*, and that define the perimeters of mounting apertures 1160*a* and 1160*b*. The mounting sections are configured so as to allow an installer to place the weld washers 1170*a* and 1170*b* in the mounting apertures 1160*a* and 1160*b*, and which removably hold or maintain the weld washers, to prevent the weld washers 1170*a* and 1170*b* from falling out of the mounting apertures prior to or during the welding process. The guides 1161*a* and 1161*b* and weld washer holders or tabs 1162*a* and 1162*b* thus coact to maintain the weld washers 1170*a* and 1170*b* in position for welding. In one embodiment as illustrated, the weld washer guides 1161*a* and 1161*b* respectively extend outwardly or transversely from the exterior surface of the mounting sections 1158*a* and 1158*b* surrounding the mounting apertures, and the holders or tabs 1162*a* and 1162*b* respectively extend from the guides 1161*a* and 1161*b* substantially parallel to the mounting apertures. This configuration allows the guide and holder to maintain the weld washer in the mounting aperture. After the weld washers are welded to the freight railroad car, this configuration enables the reflector apparatus to slide back and forth within the area defined by the guide to allow for expansion and contraction.

The reflector apparatus 1150 can be in provided in three separate parts for installation (i.e., the reflector apparatus and the two weld washers removed from the mounting sections) in accordance with the method of the present invention. The installer inserts the weld washers 1170*a* and 1170*b* into the apertures of the mounting members 1158*a* and 1158*b* and welds them to the freight railroad car in accordance with the method of the present invention.

It should also be appreciated that the mounting member or base 1152 may have structural supports to provide substantial rigidity to the mounting member or base 1152 and the entire reflector apparatus 1150. Any suitable structural supports may be employed in the reflector apparatus to provide such rigidity. The supports of the reflector apparatus 1150 also define an outer raised border, air deflector or air foil 1180. In one embodiment, because the air deflector or air foil is along all of the edges, the air deflector works to protect the leading edge whether the reflector apparatus 1150 is placed in a vertical or horizontal position. This border, air deflector or air foil functions to deflect or redirect wind from engaging the leading edge of the reflector 1154. This prevents peeling of the reflector material from the mounting member 1152.

The reflector apparatus 1150 may be made from any suitable material(s). The mounting member or base may be any suitable type of material such as a molded plastic or a stamped metal. The reflector 1154 of the reflector apparatus 1150 is in one embodiment a suitable adhesive backed reflective tape such as the reflective tape commercially available as mentioned above. It should also be appreciated that other suitable types of reflective material or reflectors may be employed in the freight railroad car reflector apparatus of the present invention.

Figure 26:
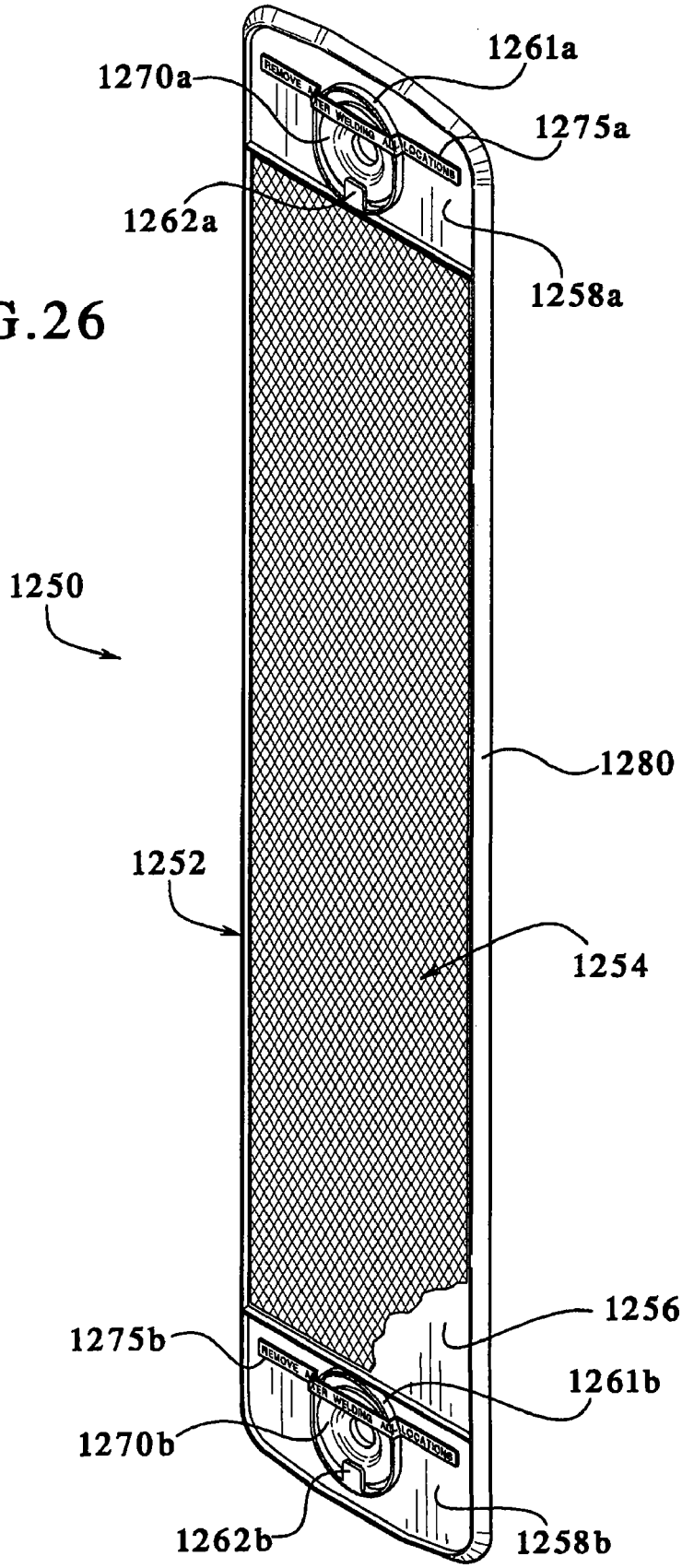
FIG. 26 is a front perspective view of the railroad car reflector apparatus of another embodiment of the present invention with a portion of the reflective material broken away to show the reflector supporter, and which is configured to removably hold a plurality of weld attachment mechanisms such as washers.
Figure 27:
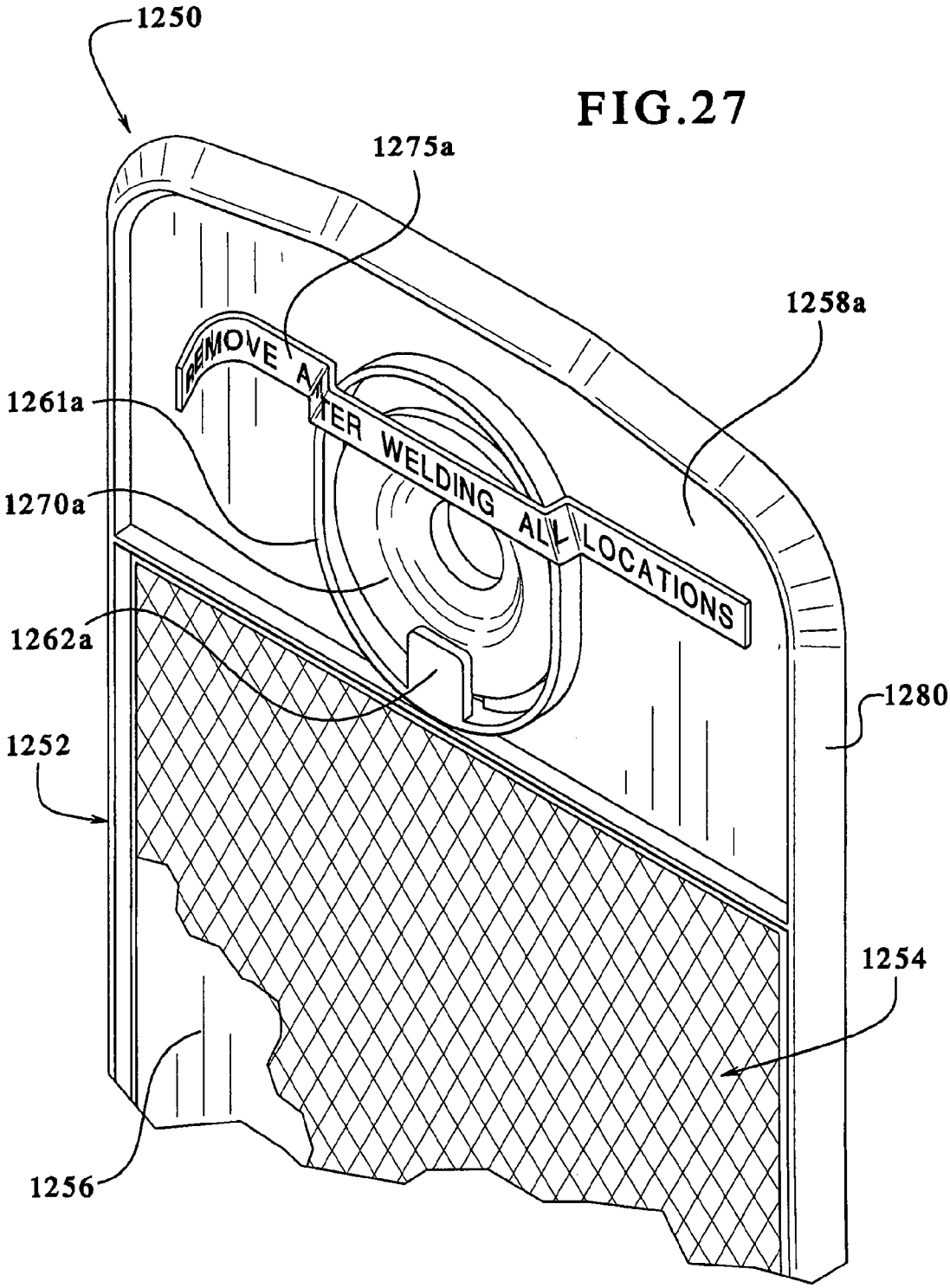
FIG. 27 is an enlarged fragmentary front perspective view of the upper section of the railroad car reflector apparatus of the embodiment of FIG. 26 with a portion of the reflective material broken away to show the reflector supporter, and showing a weld washer mounted in the upper mounting section.
Figure 28:
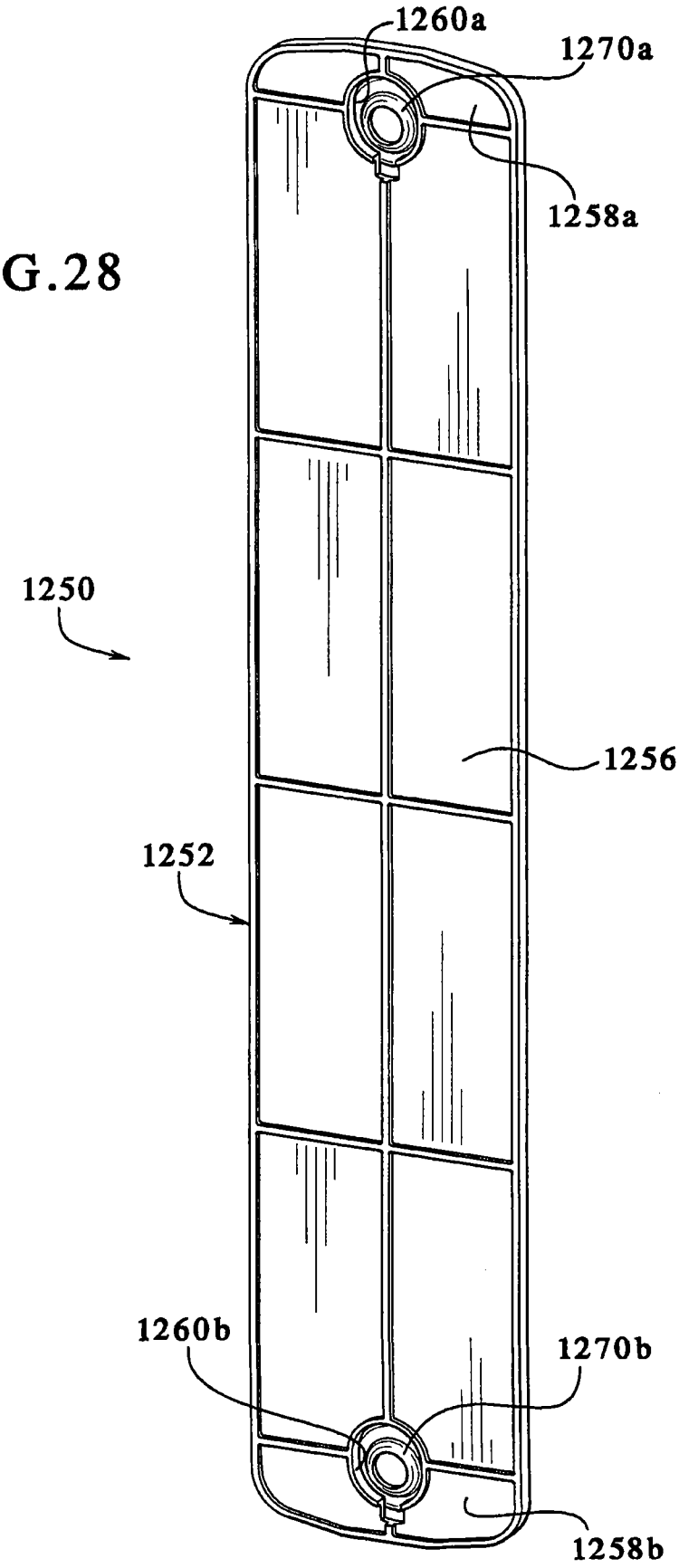
FIG. 28 is a rear perspective view of the railroad car reflector of FIG. 26.

FIGS. 26, 27 and 28 illustrate another embodiment of the reflector apparatus of the present invention which is generally indicated by numeral 1250. The railroad car reflector apparatus 1250 is identical to the reflector apparatus of FIGS. 22, 23, 24 and 25, except that it also includes removable weld washer holders 1275*a* and 1275*b* as discussed below.

More specifically, railroad car reflector apparatus 1250 includes a mounting member or base 1252, a reflector 1254 attached to a reflector supporter 1256 of the mounting member or base 1252, and mounting sections 1258*a* and 1258*b* connected to and extending from the reflector supporter 1256. The mounting sections 1258*a* and 1258*b* respectively define mounting apertures 1260*a* and 1260*b* suitably sized to receive a portion of weld washers 1270*a* and 1270*b* to facilitate attachment of the reflector apparatus 1250 to the freight railroad car. The weld washers 1270*a* and 1270*b* respectively extend beyond the mounting apertures 1260*a* and 1260*b* to provide a sufficient purchase area to enable the weld washers to maintain the mounting sections 1258*a* and 1258*b* (and the entire reflector apparatus 1250) to the freight railroad car when the weld washers are welded to the freight railroad car.

The mounting sections 1258*a* and 1258*b* have weld washer guides 1261*a* and 1261*b*, weld washer holders or tabs 1262*a* and 1262*b* and removable weld washer holders 1275*a* and 1275*b* which further hold or maintain the weld washers to prevent the weld washers 1270*a* and 1270*b* from falling out of the mounting apertures after assembly and prior to or during the welding process. The guides 1261*a* and 1261*b*, the weld washer holders or tabs 1162*a* and 1162*b* and the removable weld washer holders 1275*a* and 1275*b* coact to maintain the weld washers 1270*a* and 1270*b* in position for welding. This reflector apparatus 1250 can be provided fully assembled where the reflector apparatus has the two weld washers attached to the mounting sections. It should be appreciated that the removable weld washer holders 1275*a* and 1275*b* maintain the weld washers 1270*a* and 1270*b* in position for welding even if the railroad car reflector is placed on the car in a horizontal position. After welding, the removable weld washer holders 1275*a* and 1275*b* are removed. This facilitates the movement of the reflector apparatus relative to the stationary (i.e., welded) weld washers to allow for expansion and contraction. The guides 1261(*a*) and 1261(*b*) respectively limit the movement of the reflector apparatus.

It should also be appreciated that the mounting member or base 1252 may have structural supports to provide substantial rigidity to the mounting member or base 1252 and the entire reflector apparatus 1250. Any suitable structural supports may be employed in the reflector apparatus to provide such rigidity. The supports of the reflector apparatus 1250 also define an outer raised border, air deflector or air foil 1280. In one embodiment, because the air deflector or air foil is along all of the edges, the air deflector works to protect the leading edge whether the reflector apparatus 1250 is placed in a vertical or horizontal position. This border, air deflector or air foil functions to deflect or redirect wind from engaging the leading edge of the reflector 1254. This prevents peeling of the reflector material from the mounting member 1252.

It should also be appreciated that the reflector supporter of the present invention can be recessed relative to the rest of the mounting member to protect the edges of the reflector material.

The reflector apparatus 1250 may be made from any suitable material(s). The mounting member or base may be any suitable type of material such as a molded plastic or a stamped metal. The reflector 1254 of the reflector apparatus 1250 is in one embodiment a suitable adhesive backed reflective tape such as the reflective tape commercially available as mentioned above. It should also be appreciated that other suitable types of reflective material or reflectors may be employed in the railroad car reflector apparatus of the present invention. The removable weld washer holders 1275*a* and 1275*b* in one embodiment are made from a single sided adhesive tape.

It should be appreciated that the railroad car reflector or reflector apparatus of the present invention can be formed with any suitable number or combination of attachment mechanism, guides, and removable or non-removable holders. For instance, in one embodiment, a plurality of holders are positioned around the mounting aperture. In another embodiment, a plurality of removable holders are employed to maintain the attachment mechanism or weld washer in the mounting aperture. It should also be appreciated that the configuration, shape and size of the guides and holders may vary.

Figure 29:
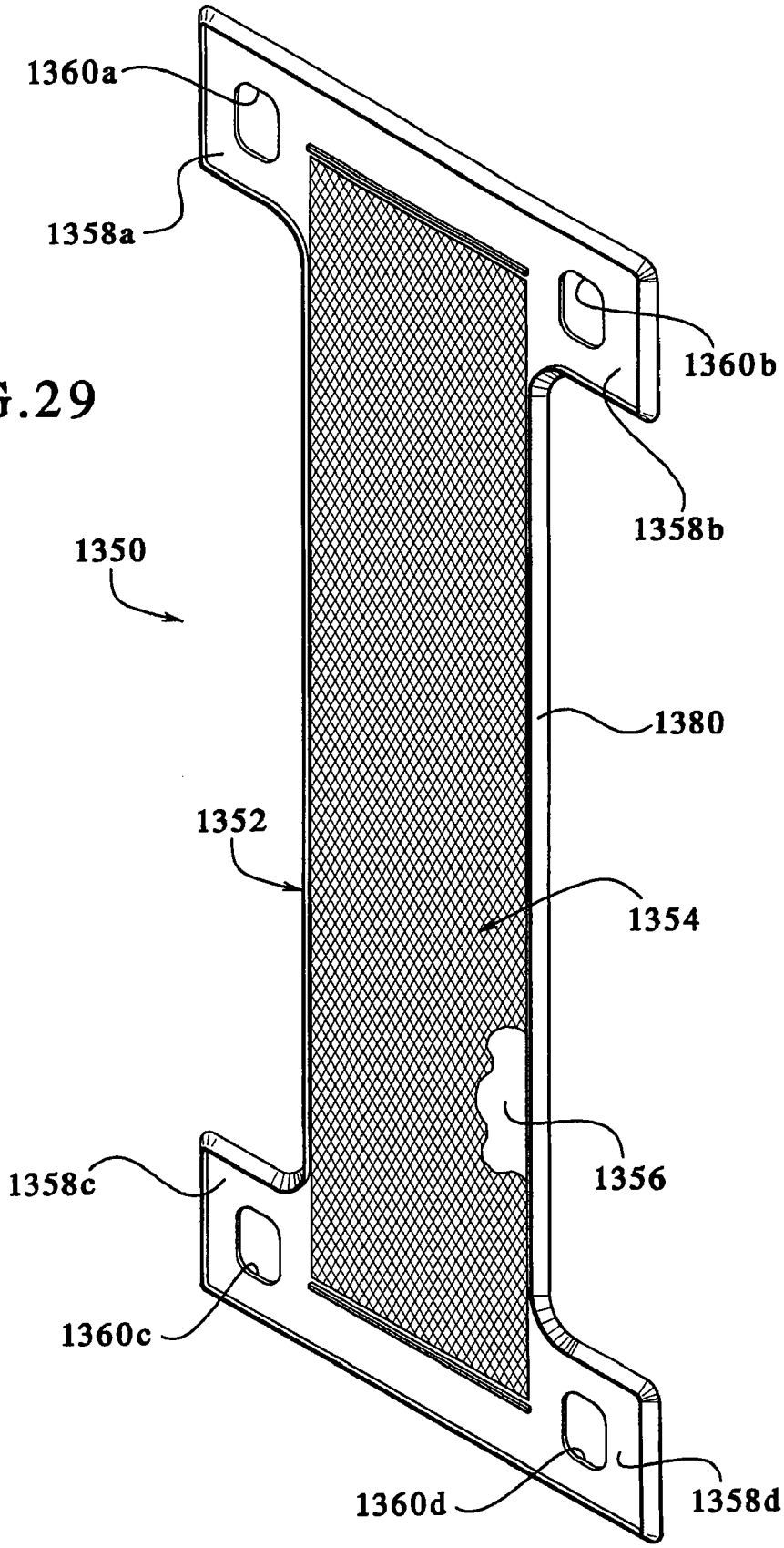
FIG. 29 is a front perspective view of another alternative embodiment of the railroad car reflector apparatus of the present invention with a portion of the reflective material broken away to show the reflector supporter.
Figure 30:
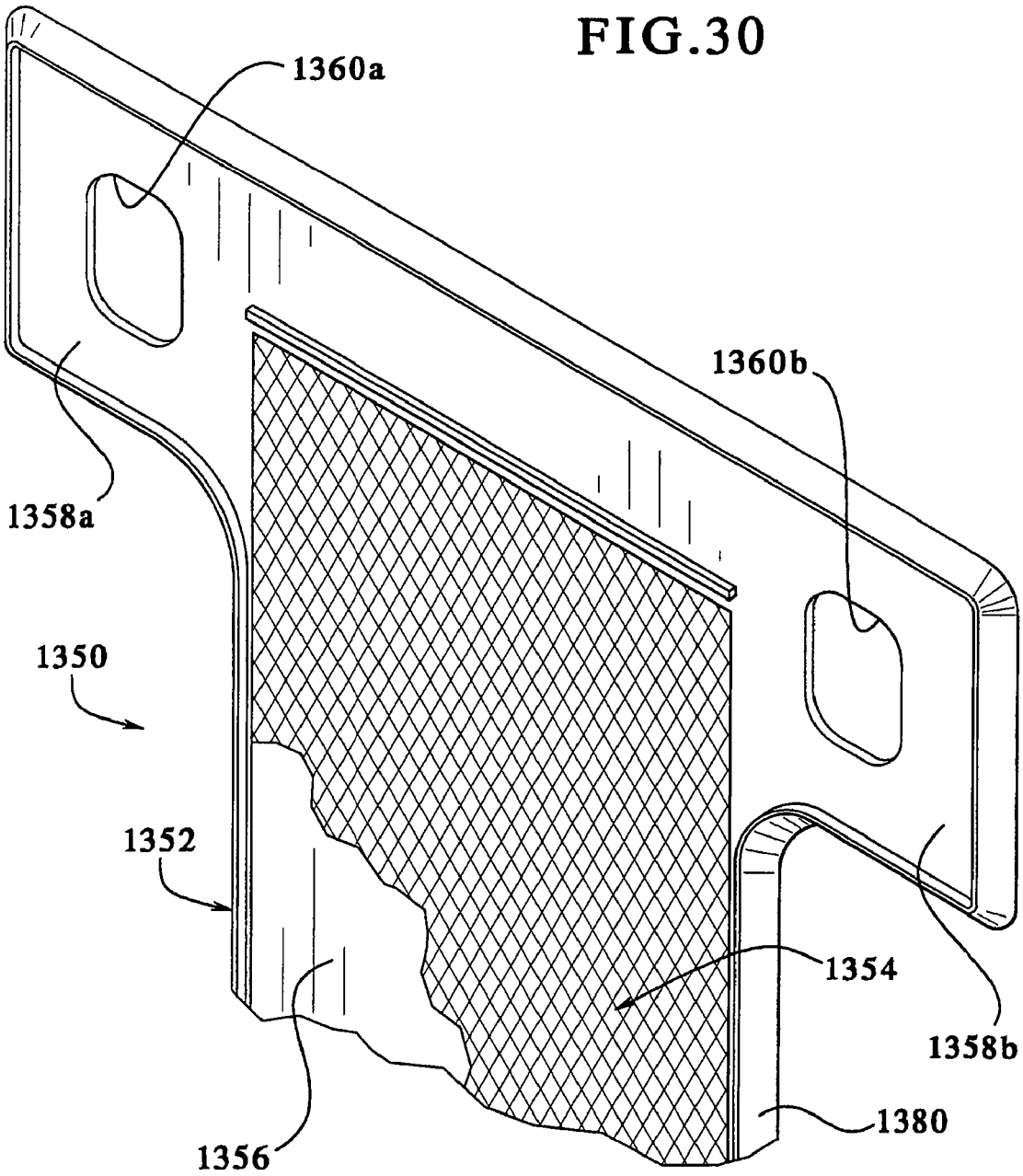
FIG. 30 is an enlarged fragmentary front perspective view of the railroad car reflector apparatus of FIG. 29 with a portion of the reflective material broken away to show the reflector supporter.

FIGS. 29 and 30 illustrate another embodiment of the reflector apparatus of the present invention which is generally indicated by numeral 1350. The railroad car reflector apparatus 1350 includes a mounting member or base 1352 and a reflector 1354 suitably attached to the mounting member or base 1352. The mounting member or base 1352 includes a reflector supporter 1356 and mounting sections 1358*a*, 1358*b*, 1358*c* and 1358*d* connected to the reflector supporter 1356. The mounting sections 1358*a*, 1358*b*, 1358*c* and 1358*d* extend from opposing ends of the reflector supporter 1356 and transversely from opposing sides of the reflector supporter 1356 in this embodiment. The mounting sections 1358*a*, 1358*b*, 1358*c* and 1358*d* respectively define mounting apertures 1360*a*, 1360*b*, 1360*c* and 1360*d* for facilitating attachment of the reflector apparatus 1350 to the freight railroad car, and more particularly to an autorack railroad car as further discussed below. It should be appreciated that the shape of the mounting apertures can vary for this embodiment and the other embodiments disclosed herein. It should be appreciated that in one embodiment, the ends of the mounting aperture are more rounded. In further embodiments the mounting apertures are oval.

The reflector apparatus 1350 also includes suitable fasteners or attachment mechanisms for attaching the mounting member or base 1352 to the freight railroad car such as the fasteners or attachment mechanisms discussed above in regard to FIGS. 4 and 5. The fasteners may be any suitable type of fastener which can attach the mounting sections to the autorack railroad car sidewall panel screens. One such type of fastener is described in U.S. Pat. No. 5,239,933. Other suitable types of commercially available fasteners may be employed in accordance with the present invention.

Each mounting section defines a mounting aperture which is shaped and sized to receive the fastener in multiple positions. In the illustrated embodiment, the mounting apertures 1360*a*, 1360*b*, 1360*c* and 1360*d* are each symmetrically shaped to facilitate attachment of the reflector apparatus in a horizontal or substantially horizontal position relative to the autorack railroad car.

The reflector apparatus 1350 may be made from any suitable material(s). The mounting member or base 1352 may be any suitable type of material such as a molded plastic or a stamped metal. The reflector 1354 of the reflector apparatus

1350 is in one embodiment a suitable adhesive backed reflective tape such as a reflective tape commercially available as mentioned above.

To install the reflector apparatus 1350 on autorack railroad car, the installer simply takes the reflector apparatus and holds it adjacent to the exterior autorack railroad car side wall panel screen in the appropriate position and inserts the fasteners in each of the mounting apertures and through the holes in the side wall panel screen.

It should also be appreciated that the mounting member or base 1352 may have structural supports such as supports or ribs (not shown) to provide substantial rigidity to the mounting member or base 1352 and the entire reflector apparatus 1350. Any suitable structural supports may be employed in the reflector apparatus to provide such rigidity. The supports of the reflector apparatus 1350 define an outer raised border, air deflector or air foil 1380. This border, air deflector or air foil 1380 functions to deflect or redirect wind from engaging the leading edge of the reflector 1354. This prevents peeling of the reflector from the mounting member 1352. It should also be appreciated that the reflector supporter of the present invention can be recessed relative to the rest of the mounting member to protect the edges of the reflector.

In an alternative embodiment, the installer can drill a hole in the freight railroad car aligned with the mounting aperture and use a blind rivet to attach the mounting member to the freight railroad car instead of welding. In this embodiment, the mounting apertures may be considerably smaller. In one such embodiment, a weld washer with a smaller hole is used in conjunction with the rivet to provide a sufficiently sized purchase area.

It should be appreciated that the mounting member provides a contrast to the reflector in one embodiment to make the reflector more viewable. In one such embodiment, the mounting member is black and the reflector is yellow.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A freight railroad car reflector apparatus comprising:

a mounting member including:

(a) a reflector supporter having opposing first and second ends, (b) a first mounting section connected to and extending from the first end of the reflector supporter, said first mounting section defining a first mounting aperture configured to facilitate attachment of said first mounting section by a first attachment mechanism to a freight railroad car, and (c) a first holder integrally formed with the first mounting section and configured to hold the first attachment mechanism, the first holder formed by a guide wall including:

(i) a first wall portion extending substantially transversely from the first mounting section on a first side of the first mounting aperture and a second wall portion extending substantially transversely from the first mounting section on a second side of the first mounting aperture, (ii) a tab extending from a free end of at least one of the first wall portion and the second wall portion and extending substantially parallel to the first mounting section, and (d) a second mounting section connected to and extending from the second end of the reflector supporter, said second mounting section defining a second mounting aperture configured to facilitate attachment of said second mounting section by a second attachment mechanism to the freight railroad car, and (e) a second holder integrally formed with the second mounting section and configured to hold the second attachment mechanism, the second holder formed by a guide wall including:

(i) a first wall portion extending substantially transversely from the second mounting section on a first side of the second mounting aperture and a second wall portion extending substantially transversely from the second mounting section on a second side of the second mounting aperture, and (ii) a tab extending from a free end of at least one of the first wall portion and the second wall portion and extending substantially parallel to the second mounting section; and a reflector adhesively attached to the reflector supporter, said reflector including an adhesive backed reflective tape.

2. The freight railroad car reflector of claim 1, wherein at least one of the mounting sections extends transversely from opposing sides of the reflector supporter.

3. The freight railroad car reflector of claim 1, wherein each of the mounting sections extends transversely from opposing sides of the reflector supporter.

4. The freight railroad car reflector of claim 1, wherein the mounting member includes an air deflector extending along at least one outer edge.

5. The freight railroad car reflector of claim 1, wherein the mounting member includes an air deflector extending around its entire outer edge.

6. The freight railroad car reflector of claim 1, wherein the reflector supporter includes a recessed reflector receipt area configured to protect edges of the reflective tape.

7. A freight railroad car reflector apparatus comprising:

a mounting member including (a) a reflector supporter having opposing first and second ends, (b) a first mounting section connected to and extending from the first end of the reflector supporter, said first mounting section defining a first mounting aperture, and (c) a first holder integrally formed with the first mounting section and holding a first weld washer in the first mounting aperture for facilitating attachment of the first mounting section to a freight railroad car, the first holder formed by a guide wall including:

(i) a first wall portion extending substantially transversely from the first mounting section on a first side of the first mounting aperture and a second wall portion extending substantially transversely from the first mounting section on a second side of the first mounting aperture, and (ii) a tab extending from a free end of at least one of the first wall portion and the second wall portion and extending substantially parallel to the first mounting section, and (d) a second mounting section connected to and extending from the second end of the reflector supporter, said second mounting section defining a second mounting aperture, and (e) a second holder integrally formed with the second mounting section and holding a second weld washer in the second mounting aperture for facilitating attachment of the second mounting section to the freight railroad car, the second holder formed by a guide wall including:

(i) a first wall portion extending substantially transversely from the second mounting section on a first side of the second mounting aperture and a second wall portion extending substantially transversely from the second mounting section on a second side of the second mounting aperture, and (ii) a tab extending from a free end of at least one of the first wall portion and the second wall portion and extending substantially parallel to the second mounting section; and a reflector adhesively attached to the reflector supporter, said reflector including an adhesive backed reflective tape.

8. The freight railroad car reflector of claim 7, wherein the mounting member includes an air deflector extending along at least one outer edge.

9. The freight railroad car reflector of claim 7, wherein the mounting member includes an air deflector extending around its entire outer edge.

10. The freight railroad car reflector of claim 7, wherein the reflector supporter includes a recessed reflector receipt area configured to protect edges of the reflective tape.

11. An autorack railroad car reflector apparatus comprising:

a mounting member including:

(a) a reflector supporter, and (b) a plurality of mounting sections connected to and extending from the reflector supporter, each of said plurality of mounting sections having a plurality of sets of fastener positioning walls, each set of fastener positioning walls including:

(i) a first outwardly extending guide wall having a tab at its free end; and (ii) a second substantially curved wall integrally formed with the first guide wall, the second substantially curved wall extending perpendicular to the first outwardly extending guide wall wherein each of said set of fastener positioning walls define a first mounting apertures, said first mounting aperture configured to facilitate attachment of the mounting member to an autorack railroad car by one of a plurality of fasteners; and a reflector attached to the reflective supporter, said reflector including an adhesive backed reflective tape.

12. The autorack railroad car reflector of claim 11, wherein the mounting member includes an air deflector extending along at least one outer edge.

13. The autorack railroad car reflector of claim 11, wherein the mounting member includes an air deflector extending around its entire outer edge.

14. The autorack railroad car reflector of claim 11, wherein the reflector supporter includes a recessed reflector receipt area configured to protect edges of the reflective tape.

* * * * *